US007905614B2

(12) United States Patent
Aoki

(10) Patent No.: US 7,905,614 B2
(45) Date of Patent: Mar. 15, 2011

(54) REFRIGERATOR

(75) Inventor: Hiroshi Aoki, Shiga (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/676,440

(22) PCT Filed: Aug. 27, 2009

(86) PCT No.: PCT/JP2009/004179

§ 371 (c)(1),
(2), (4) Date: Mar. 22, 2010

(87) PCT Pub. No.: WO2010/023926

PCT Pub. Date: Mar. 4, 2010

(65) Prior Publication Data

US 2010/0170279 A1 Jul. 8, 2010

(30) Foreign Application Priority Data

Aug. 27, 2008 (EP) ..... 08163061

(51) Int. Cl.
*F25D 27/00* (2006.01)

(52) U.S. Cl. ..... 362/92; 362/126; 62/264; 312/116

(58) Field of Classification Search ..... 362/92, 362/94, 126, 218; 62/264; 312/116
See application file for complete search history.

(56) References Cited

U.S. PATENT DOCUMENTS

| | | | | |
|---|---|---|---|---|
| 7,736,010 | B2 * | 6/2010 | Lee | 362/92 |
| 2003/0137828 | A1 * | 7/2003 | Ter-Hovhannisian | 362/92 |
| 2005/0265019 | A1 | 12/2005 | Sommers et al. | |
| 2007/0171647 | A1 | 7/2007 | Artwohl et al. | |
| 2007/0266723 | A1 | 11/2007 | Lee et al. | |
| 2008/0066475 | A1 | 3/2008 | Cho et al. | |
| 2008/0247154 | A1 | 10/2008 | Lim et al. | |

FOREIGN PATENT DOCUMENTS

| | | |
|---|---|---|
| DE | 10 2008 010 054 | 10/2008 |
| EP | 1 857 757 | 11/2007 |
| JP | 2005-344975 | 12/2005 |
| WO | 2008/026137 | 3/2008 |
| WO | 2008/148833 | 12/2008 |
| WO | 2008/155705 | 12/2008 |

* cited by examiner

*Primary Examiner* — Stephen F Husar
(74) *Attorney, Agent, or Firm* — Hamre, Schumann, Mueller & Larson, P.C.

(57) ABSTRACT

The refrigerator includes the following parts. A heat-insulating main body has openings in a front side. A divider creates a first storage compartment and a second storage compartment, by dividing inside of said heat-insulating main body into the first storage compartment and the second storage compartment arranged side by side. A lighting unit, located close to at least one of the openings of the first and second storage compartments, respectively, each of which has a light-emitting diode as a light source.

21 Claims, 25 Drawing Sheets

[Fig. 1]
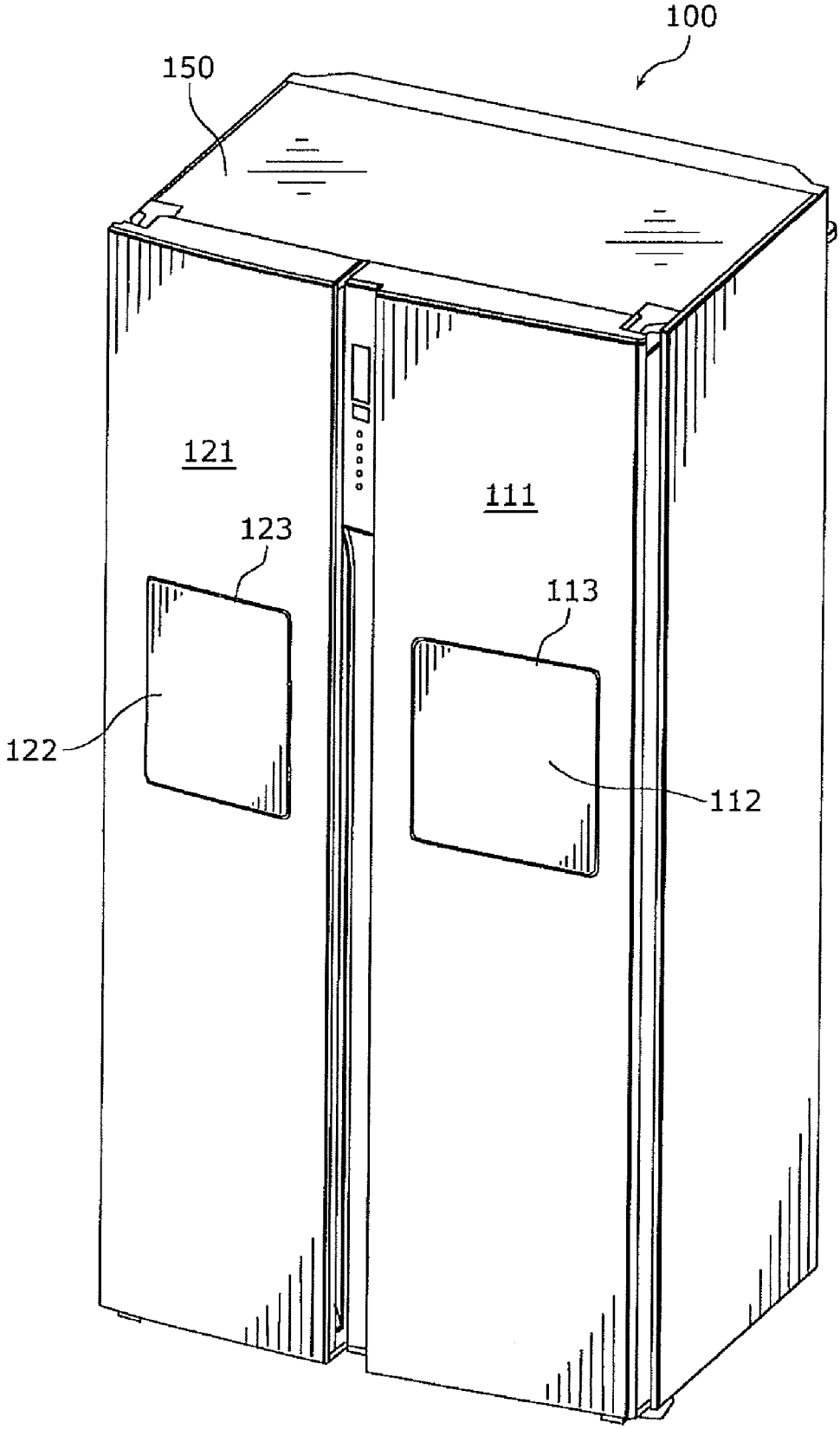

[Fig. 2]
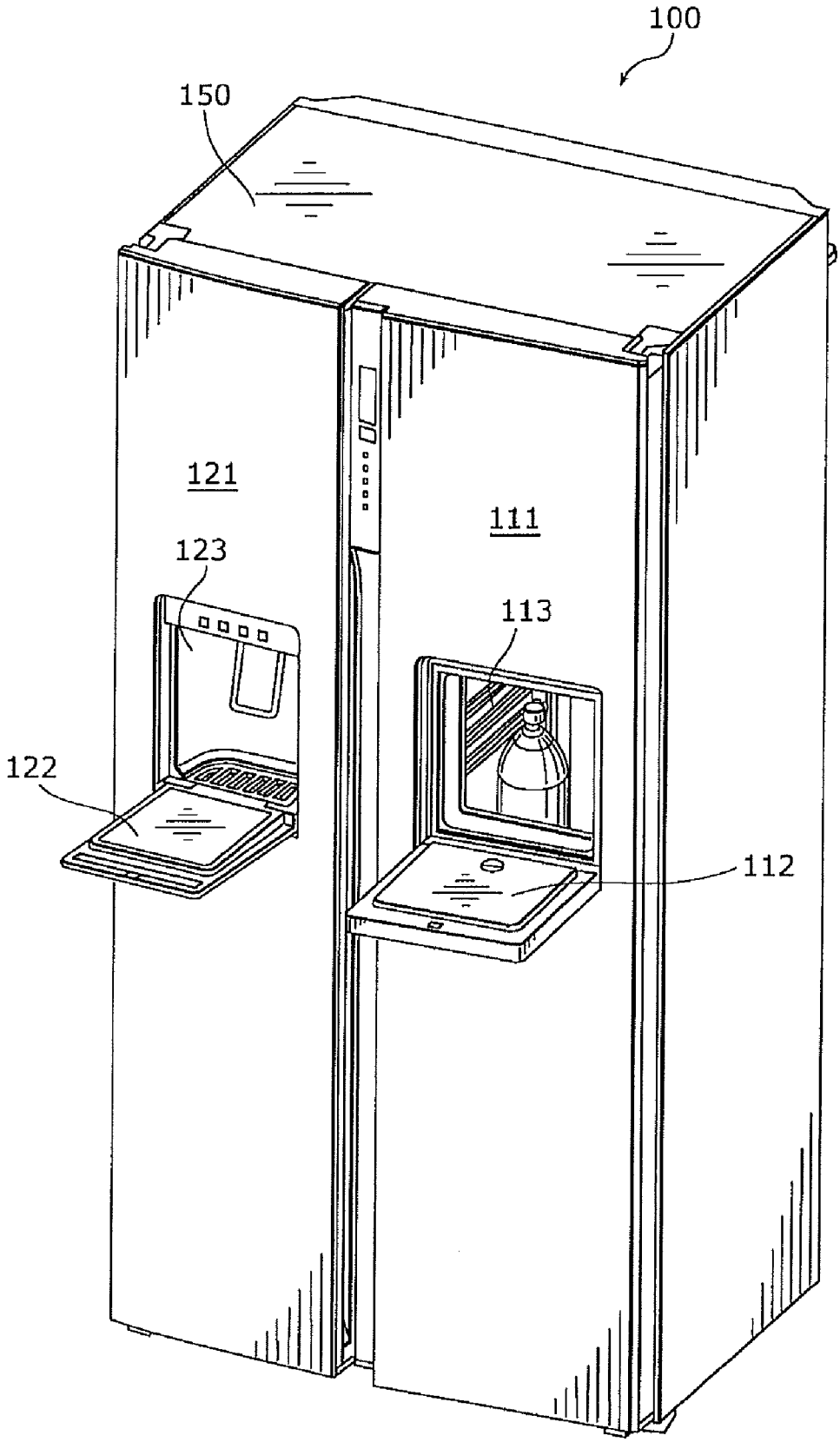

[Fig. 3]
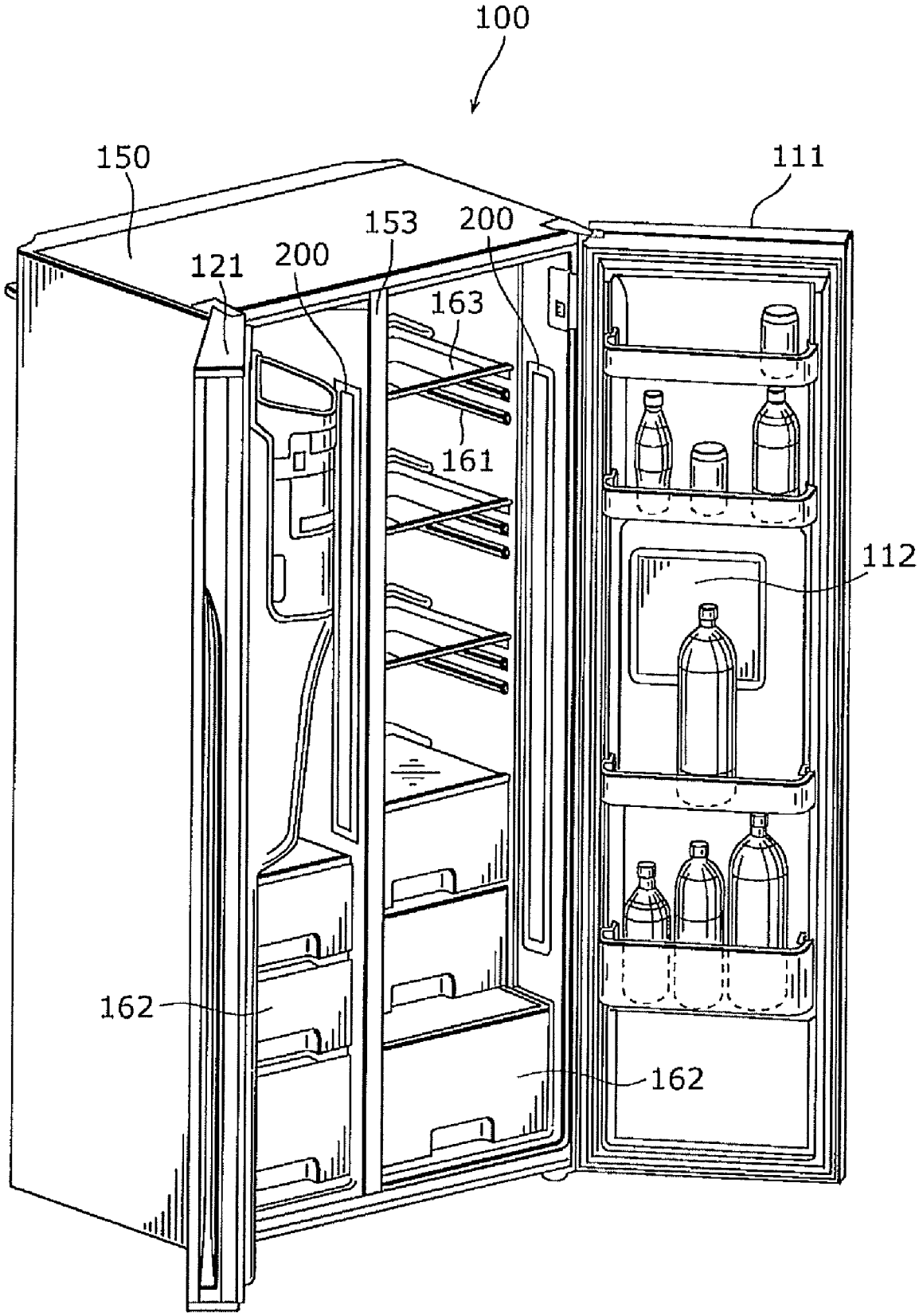

[Fig. 4]
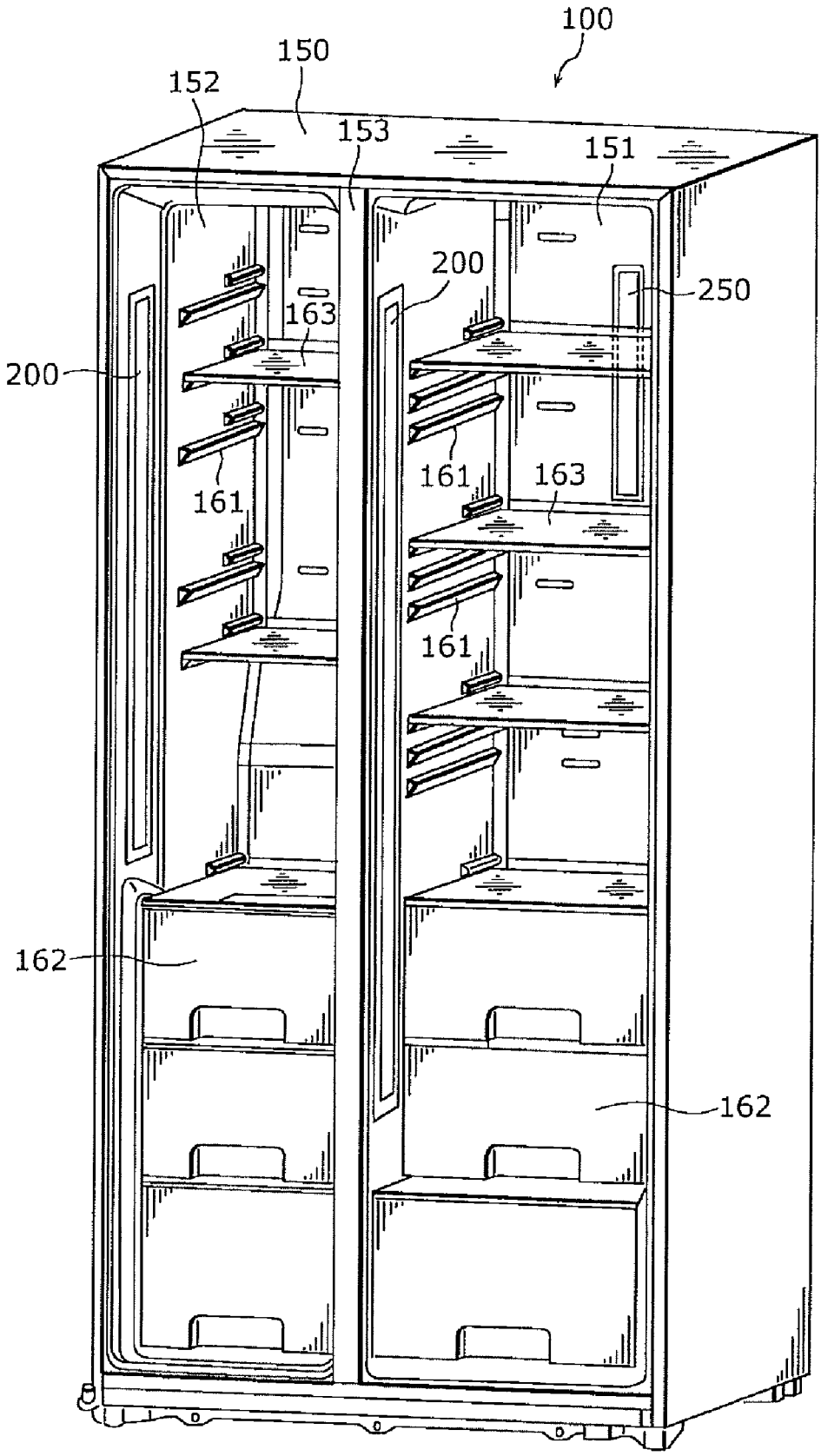

[Fig. 5]
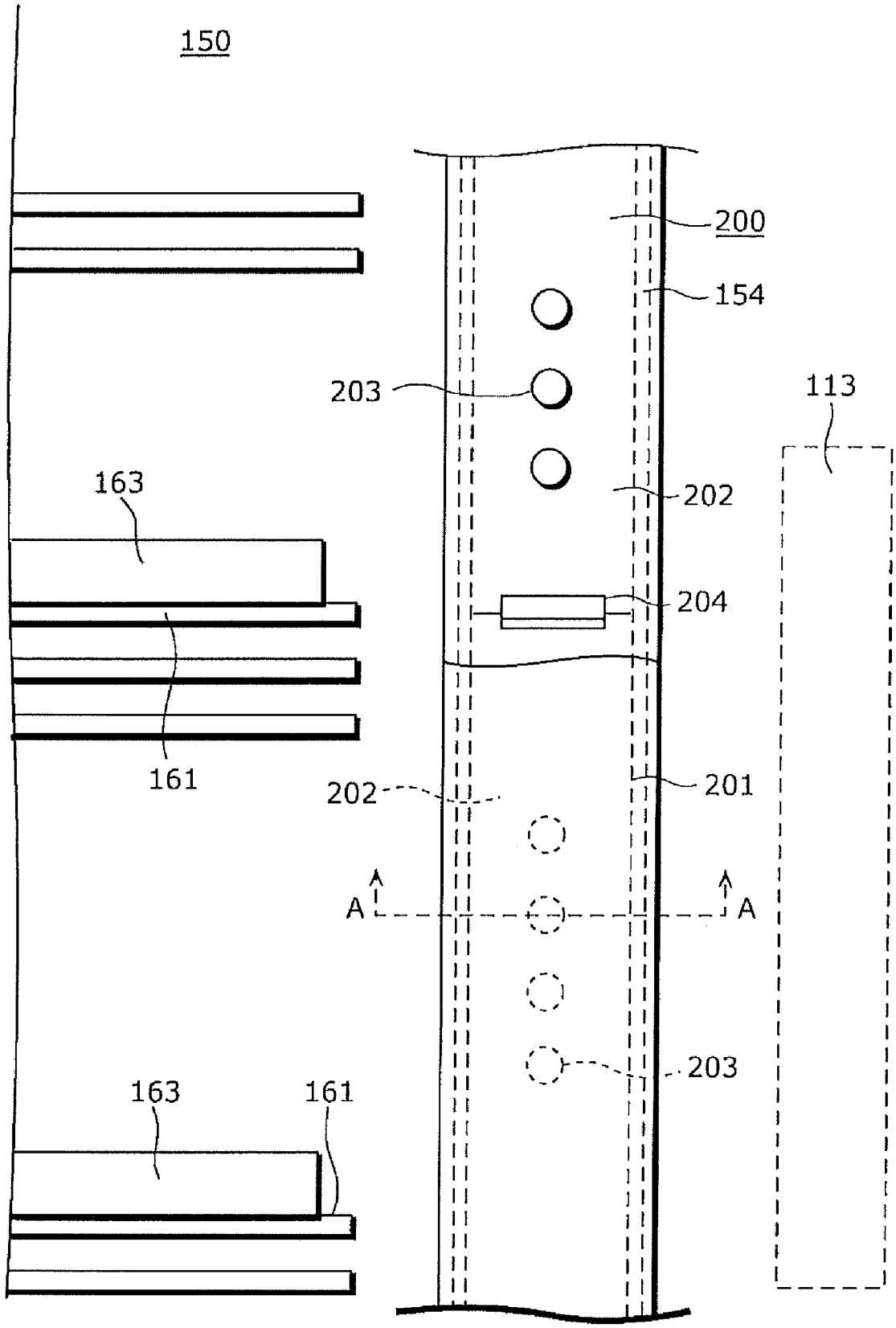

[Fig. 6]
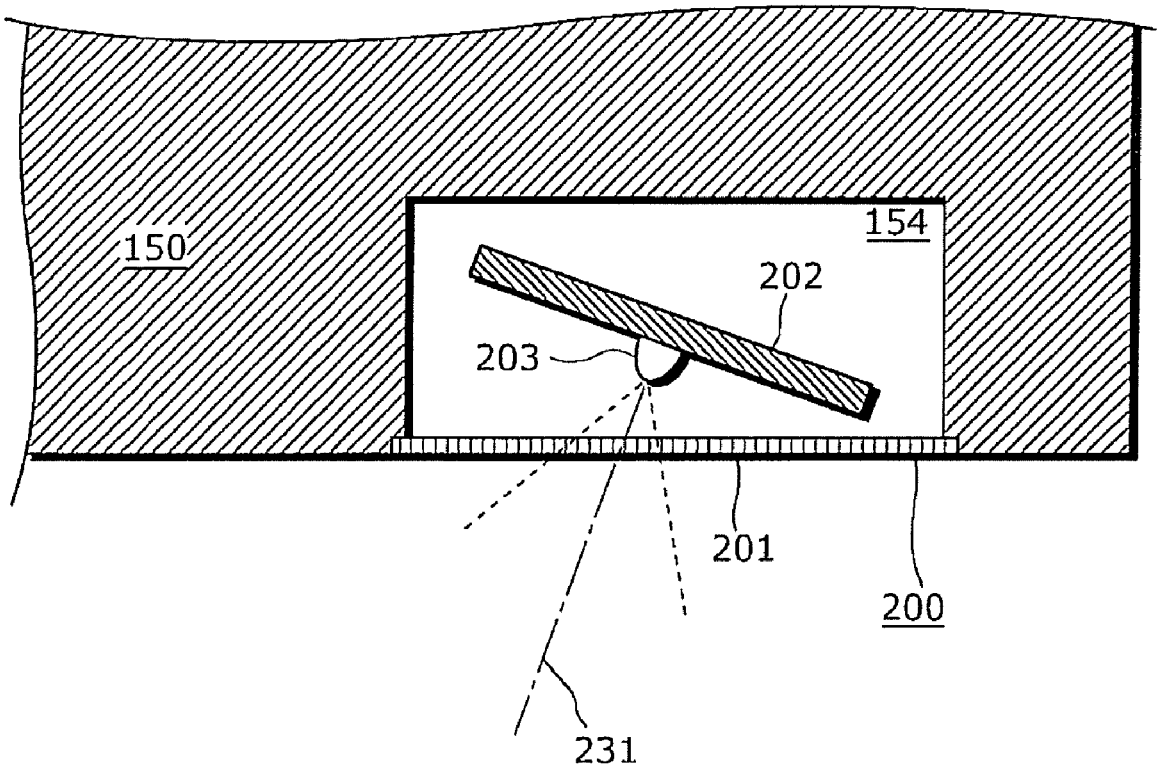

[Fig. 7]
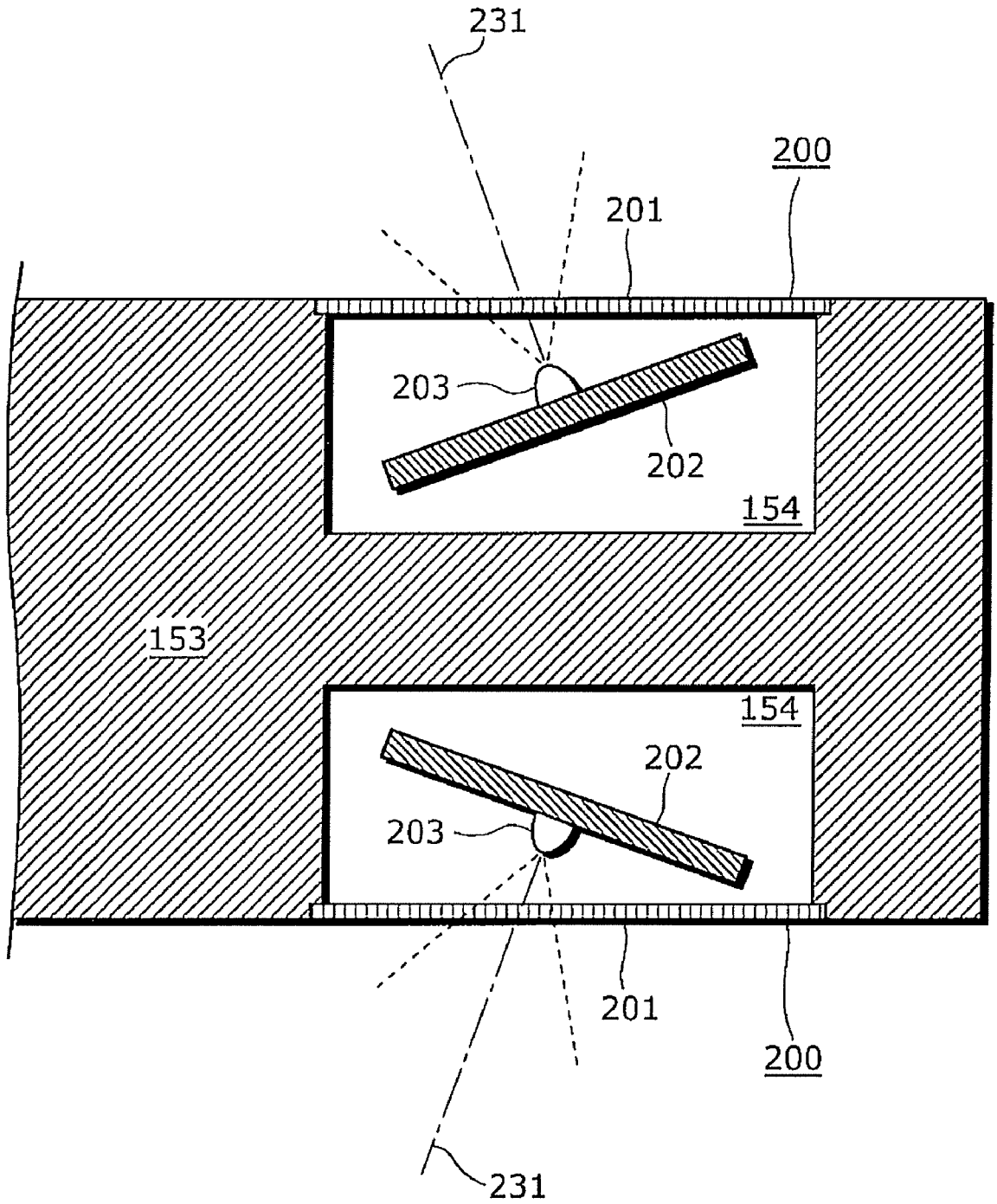

[Fig. 8]
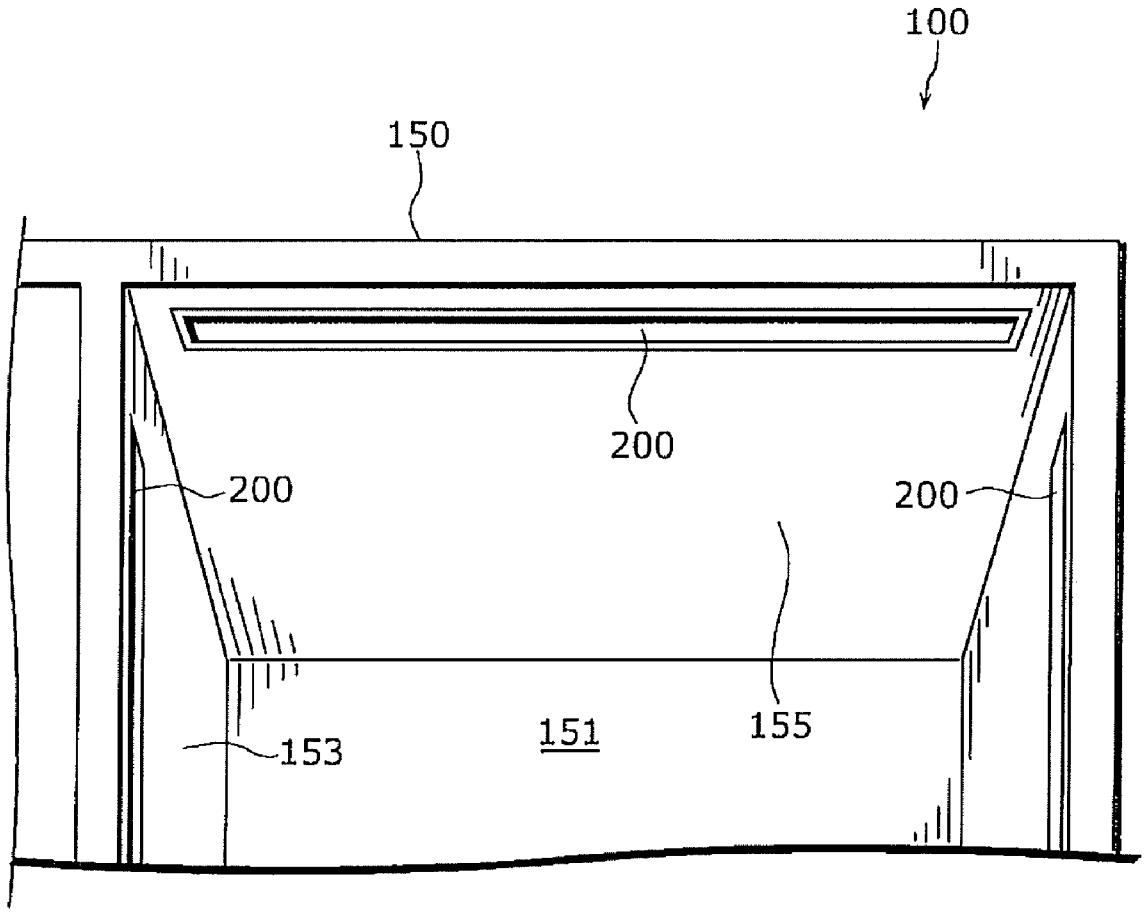

[Fig. 9]
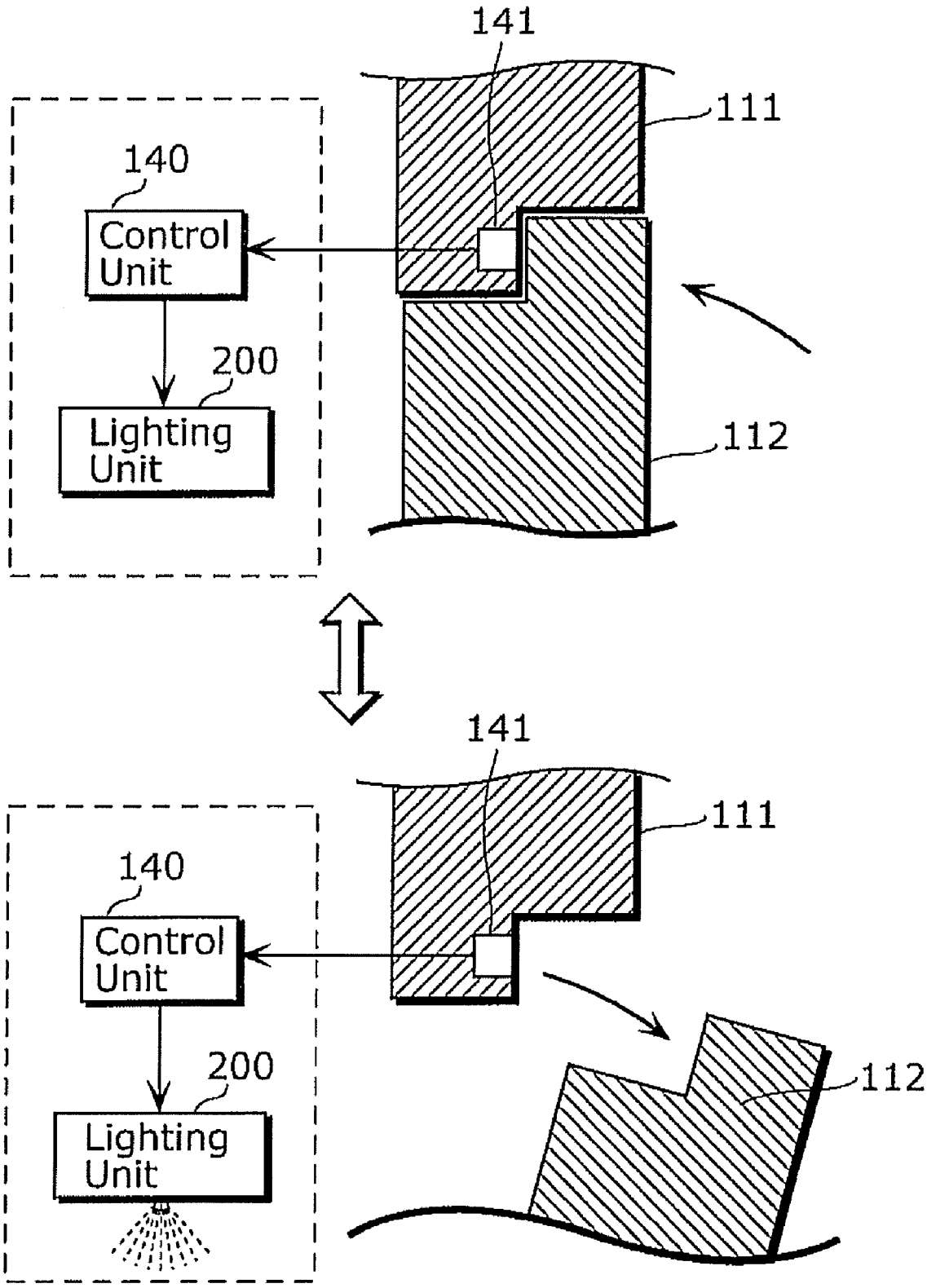

[Fig. 10]
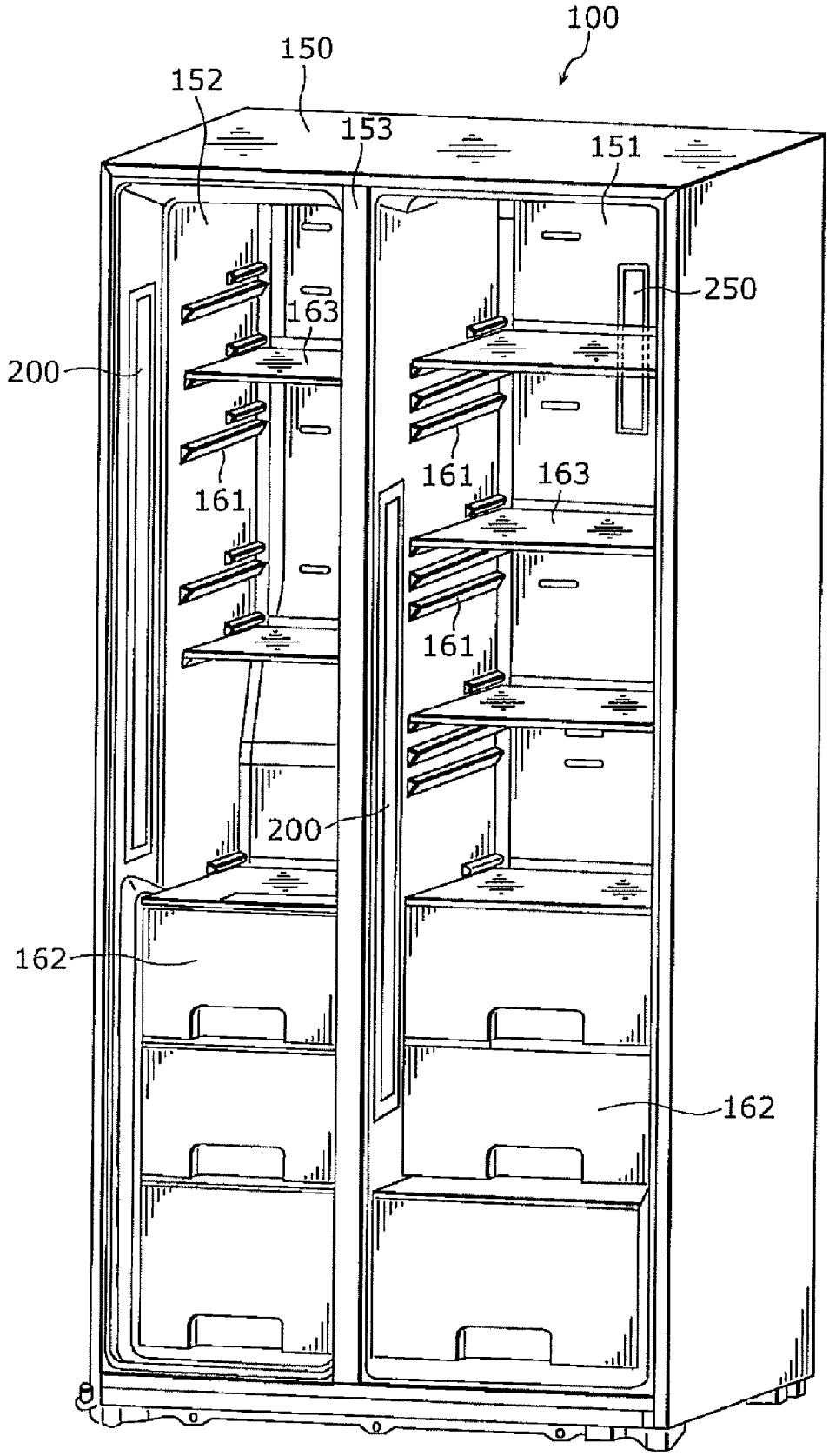

[Fig. 11]
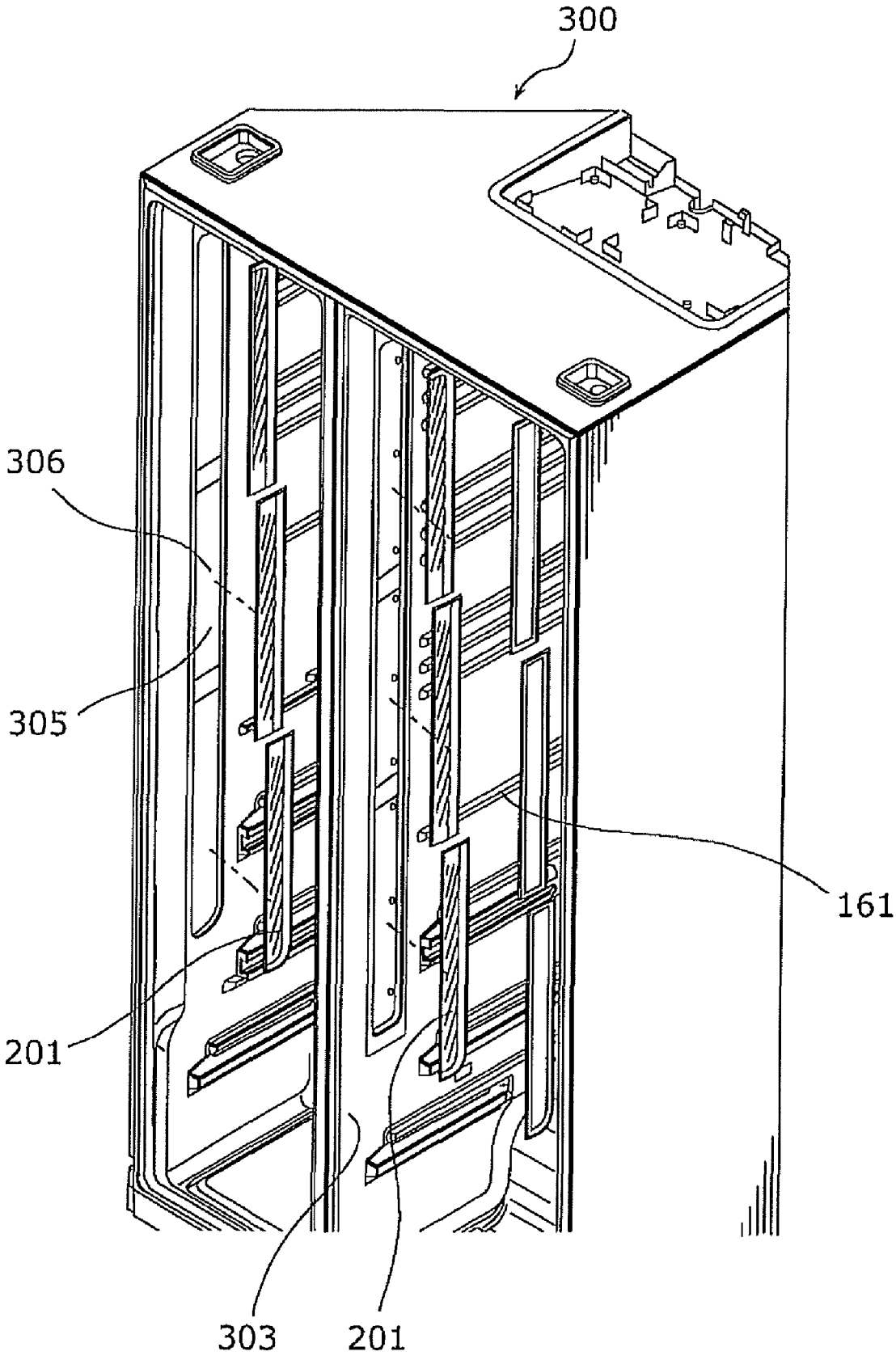

[Fig. 12]
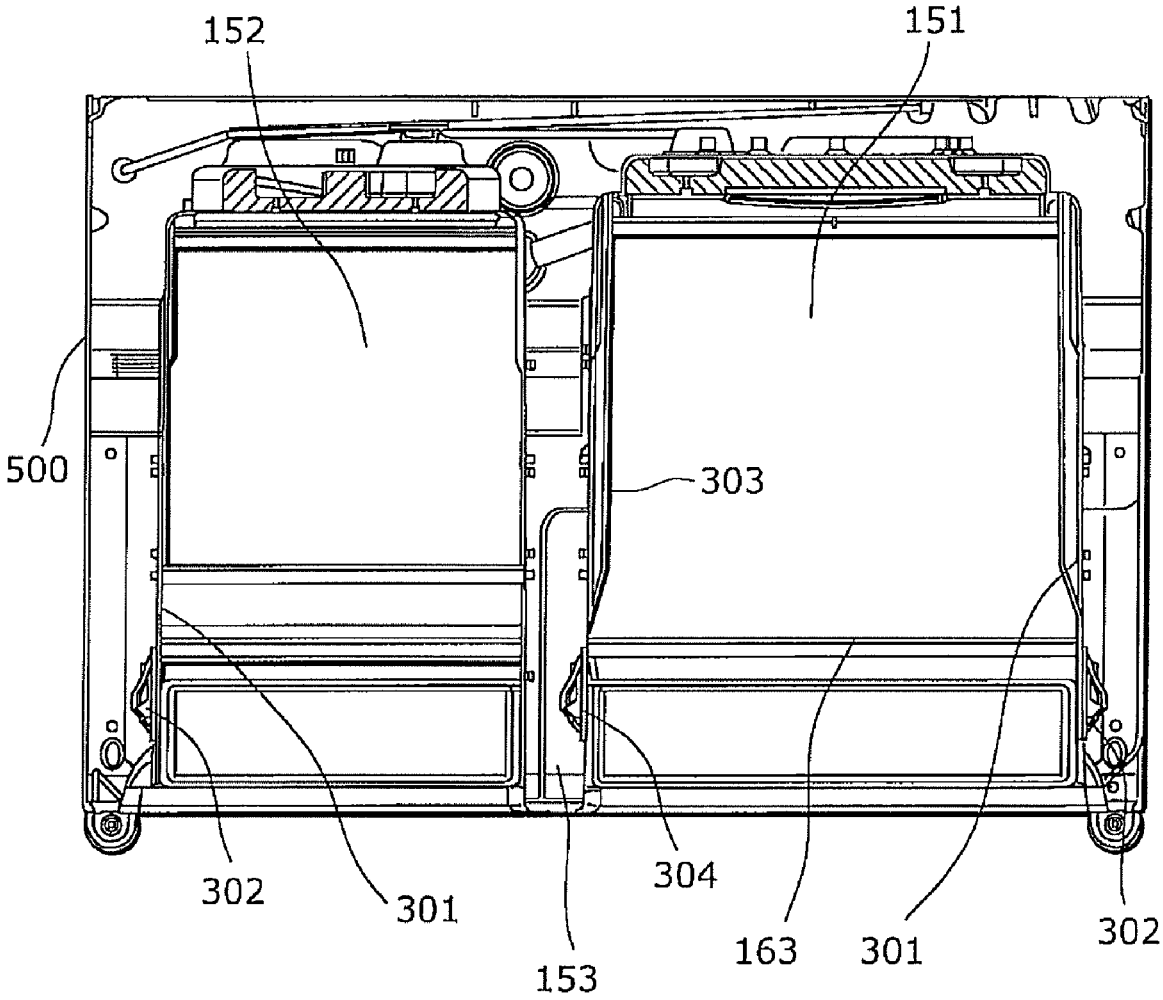

[Fig. 13]
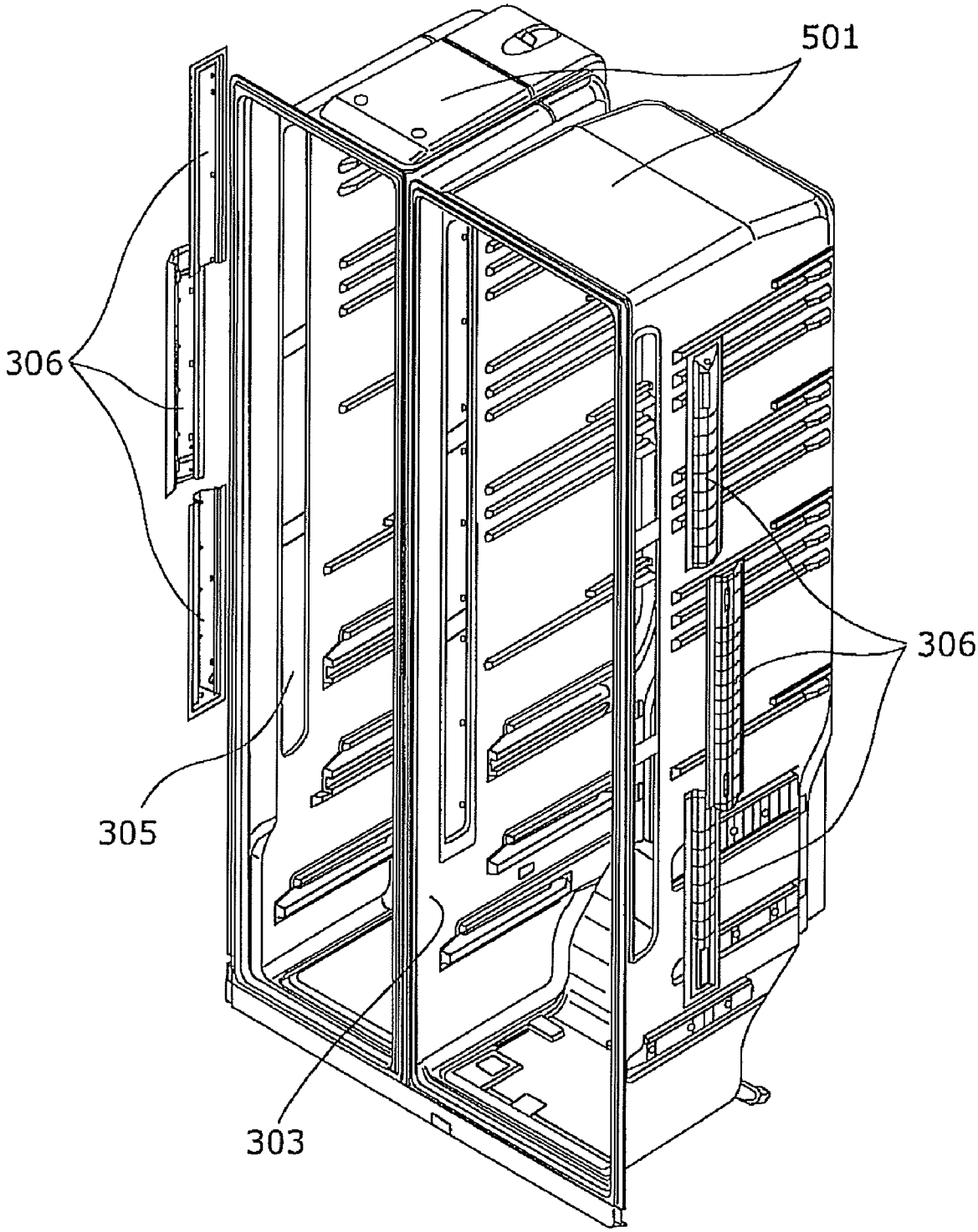

[Fig. 14]
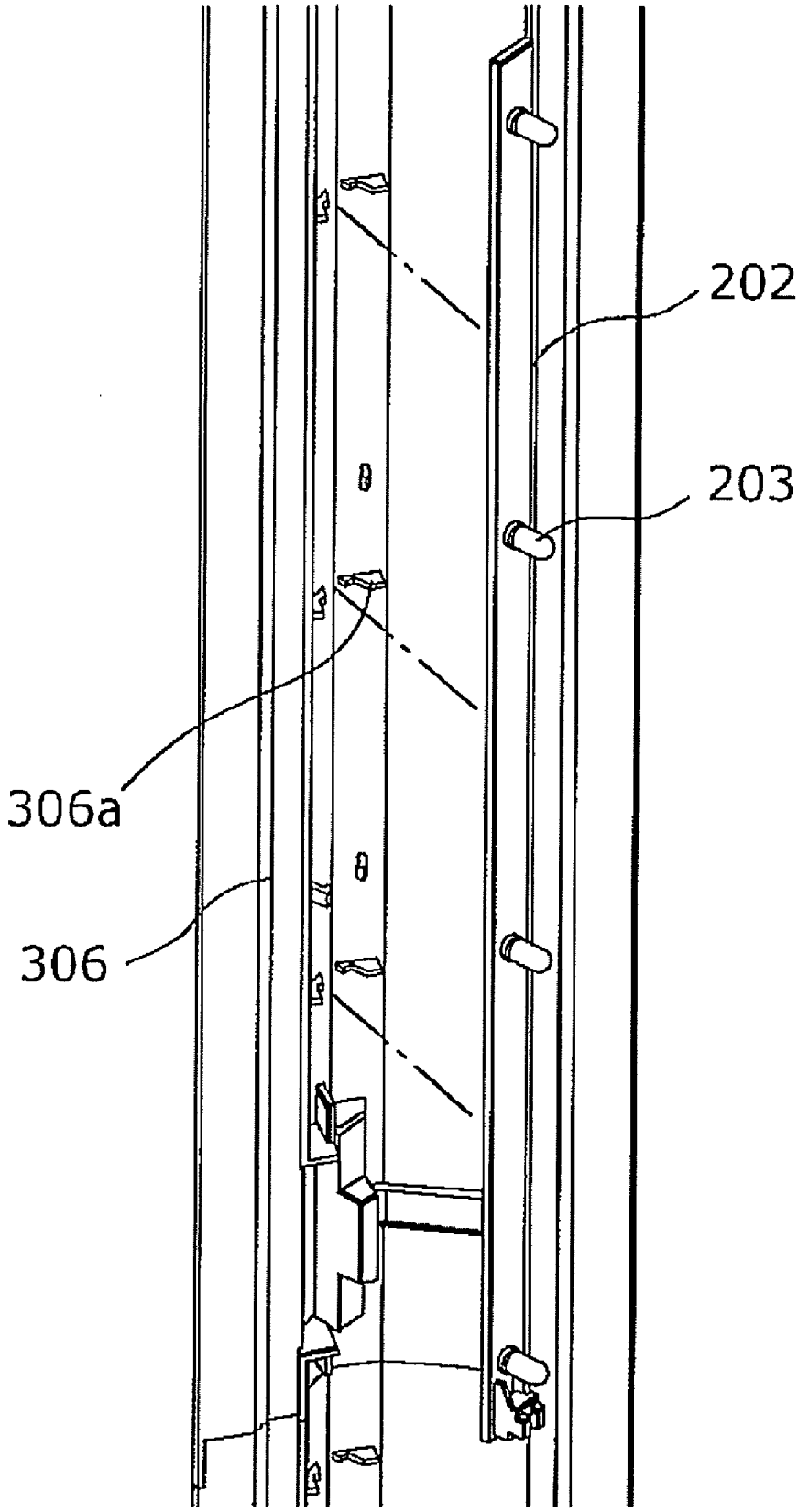

[Fig. 15]
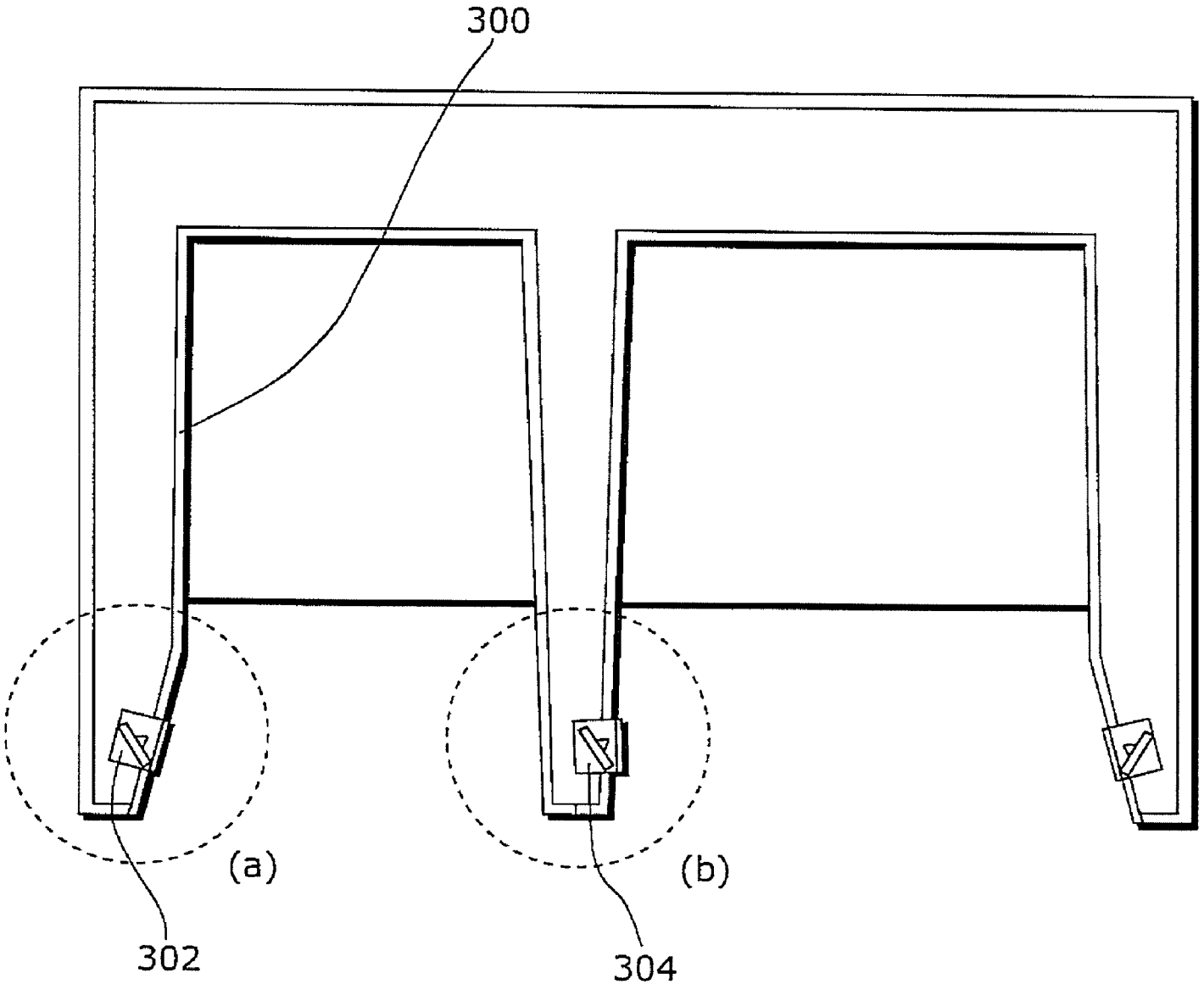

[Fig. 16]
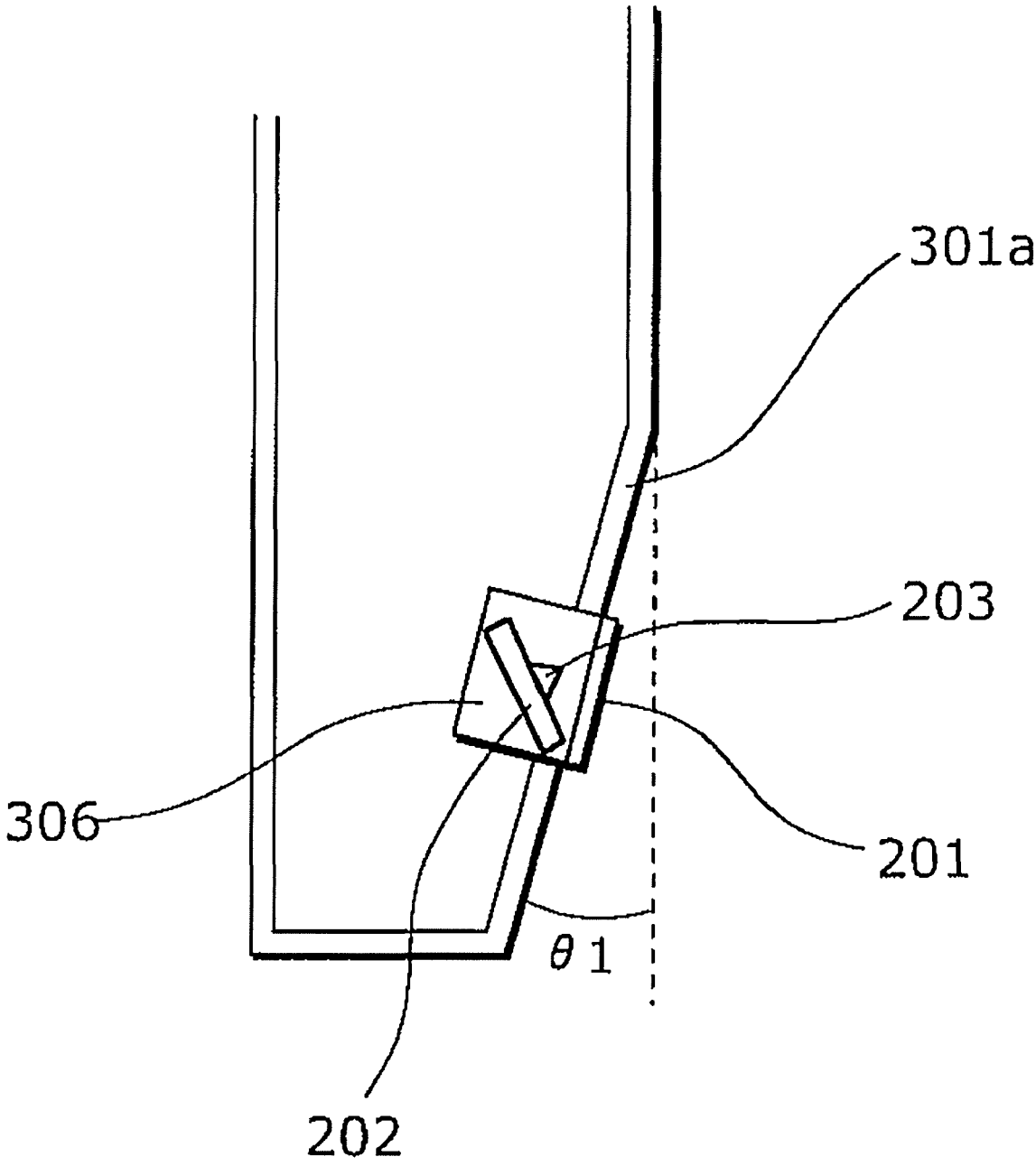

[Fig. 17]
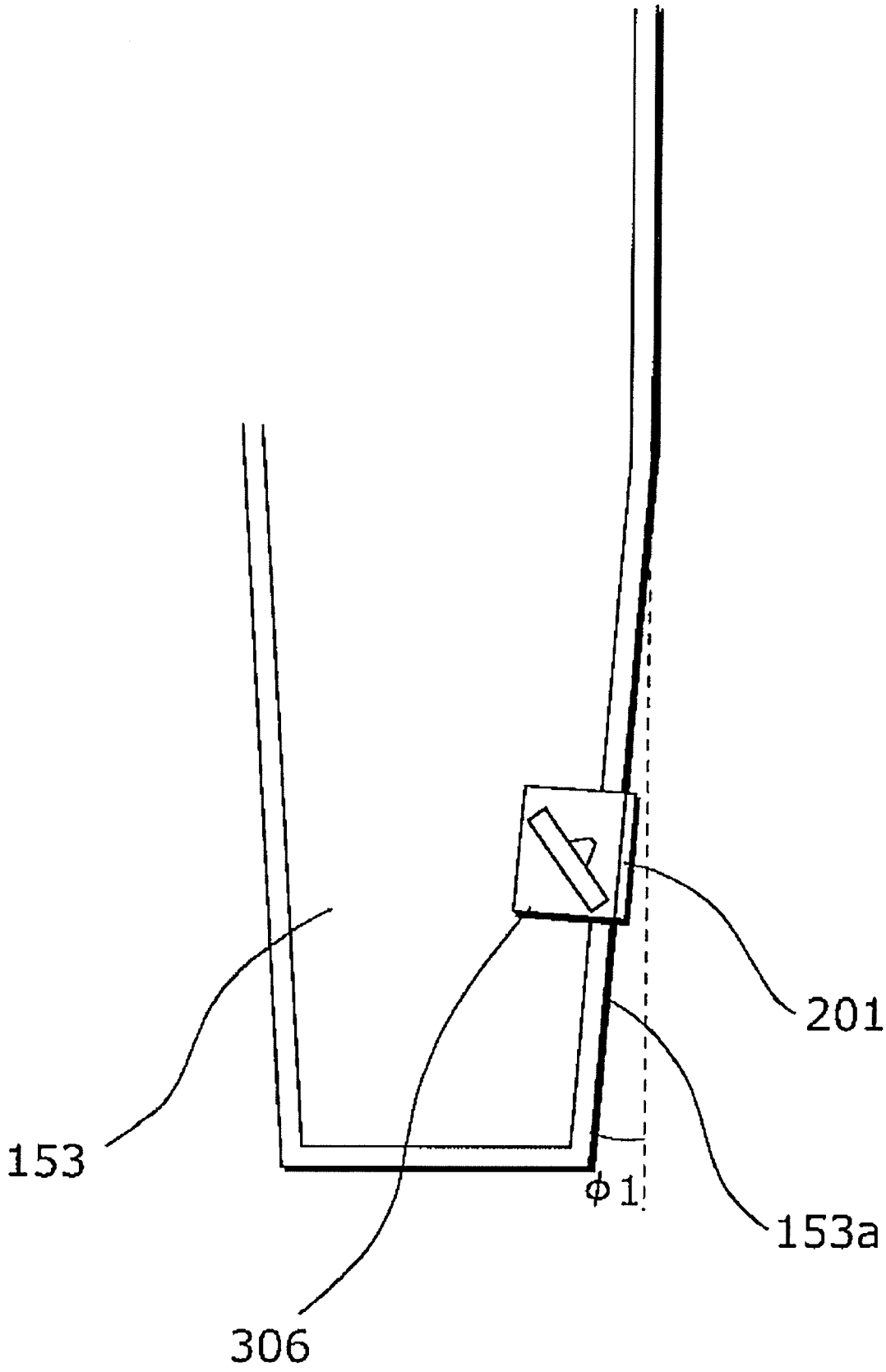

[Fig. 18]
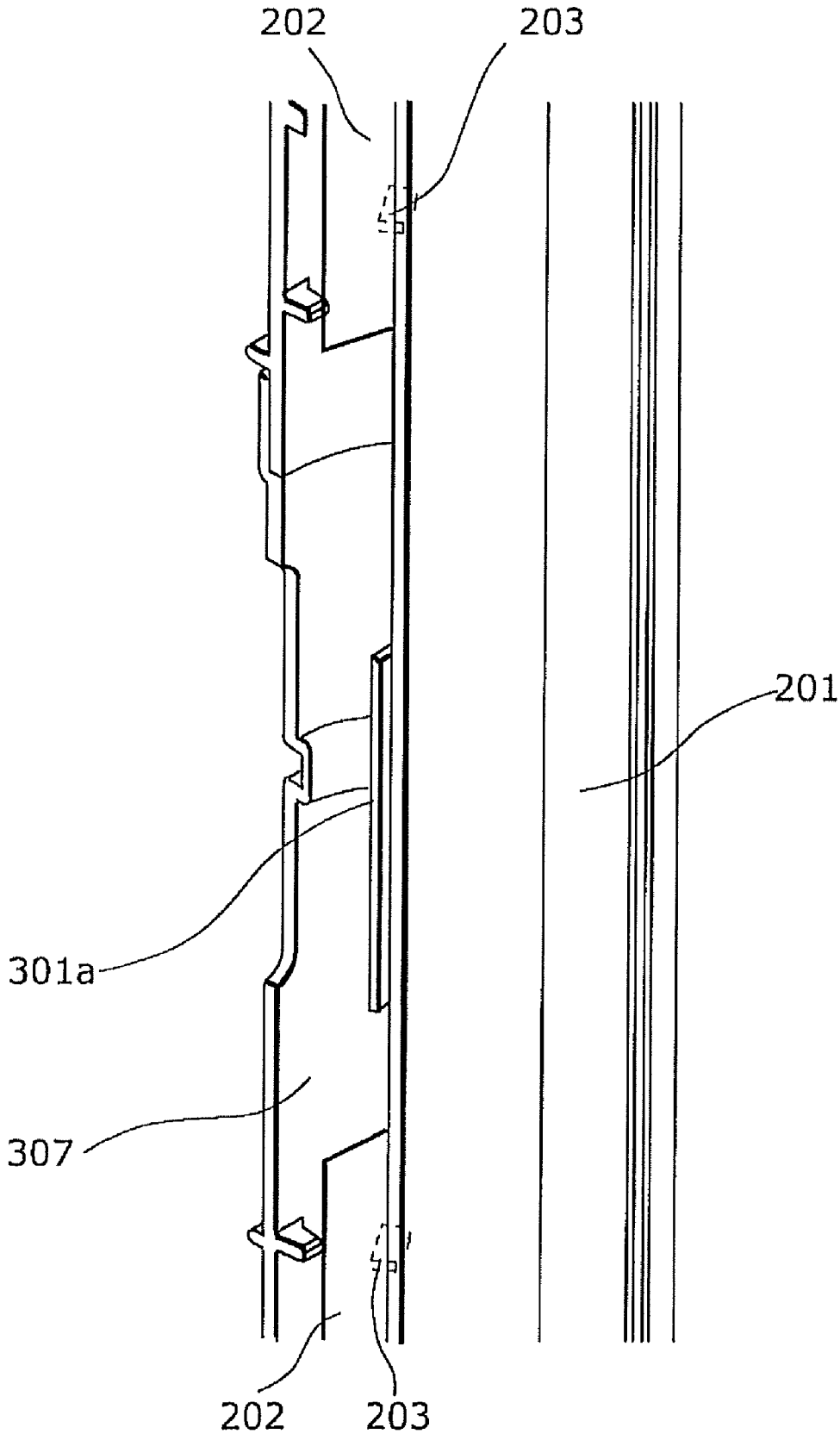

[Fig. 19]
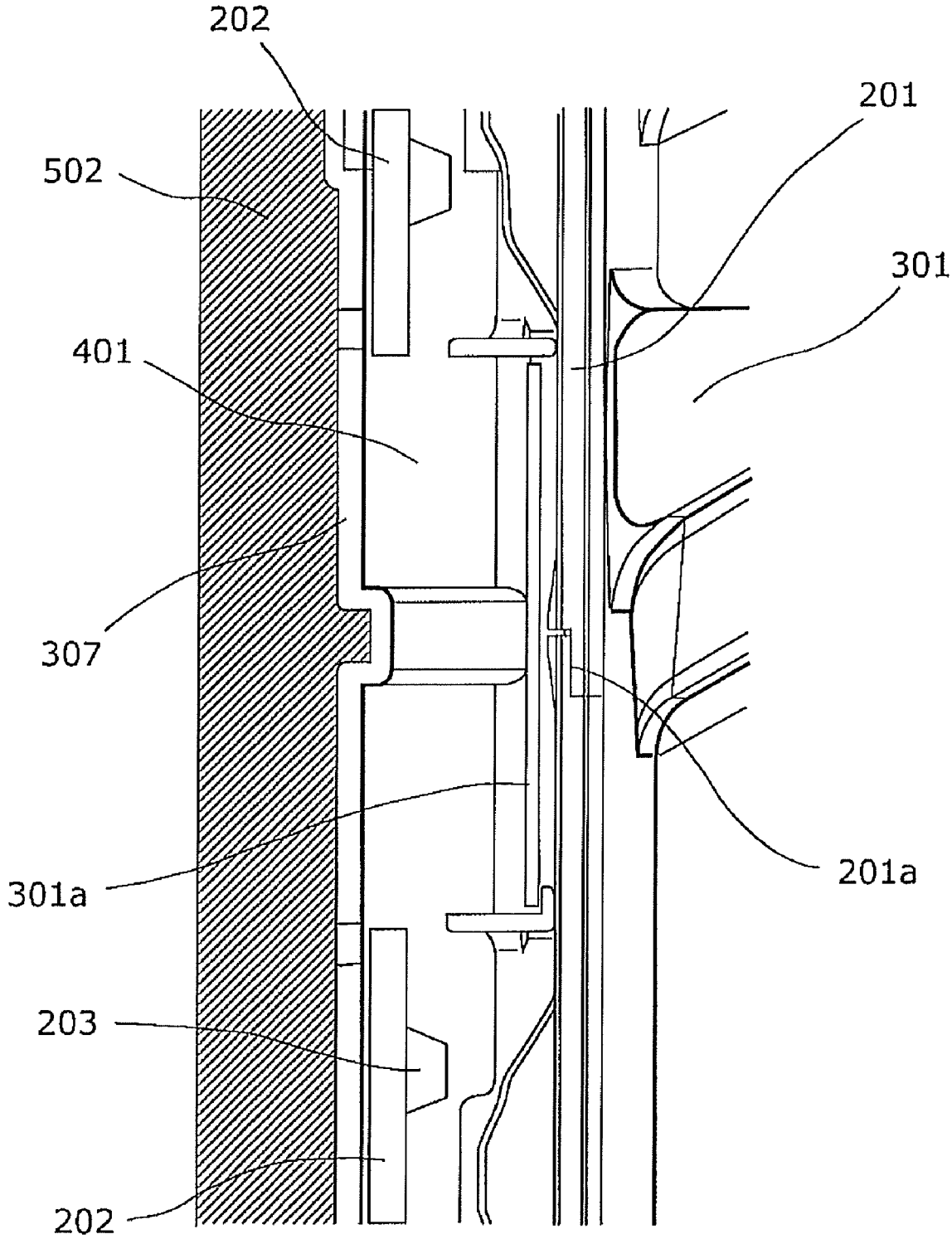

[Fig. 20A]
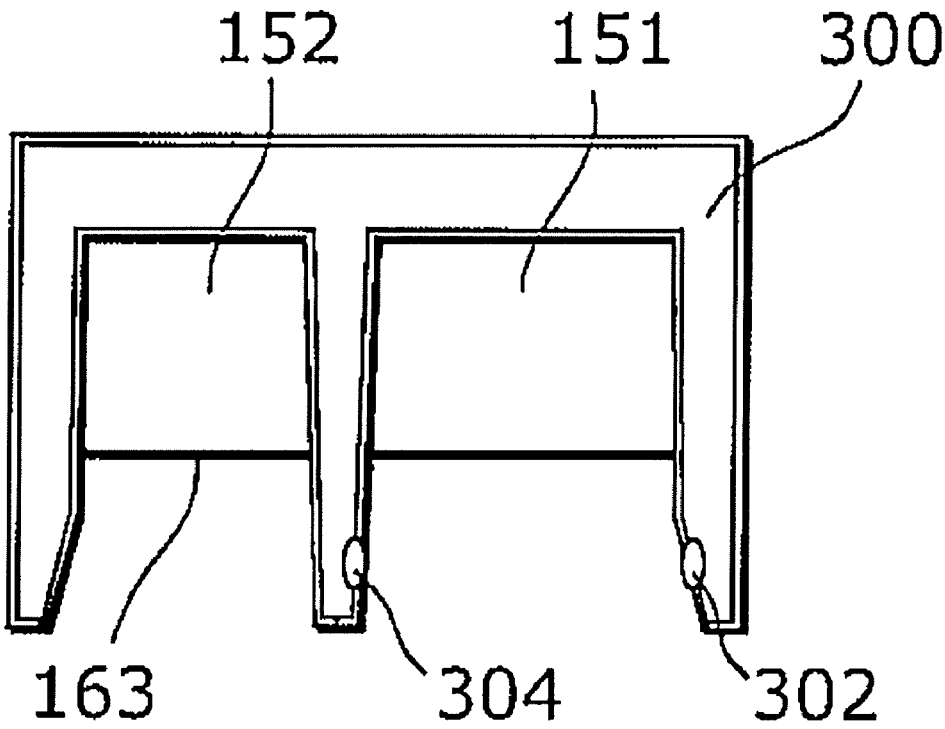
[Fig. 20B]
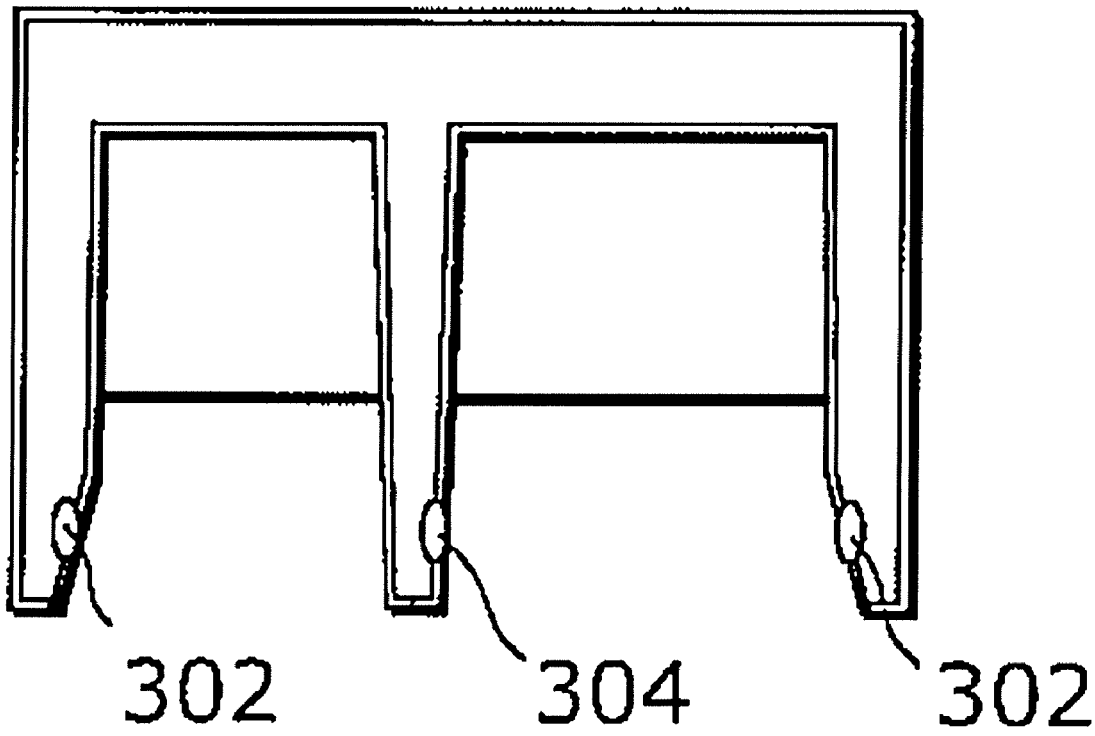

[Fig. 20C]
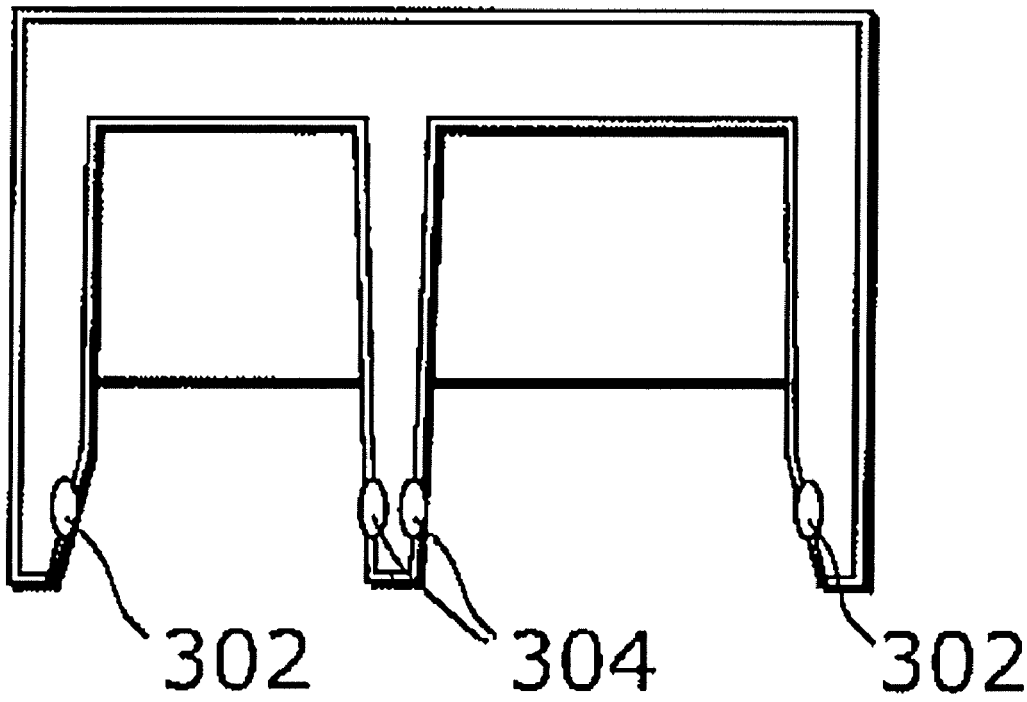
[Fig. 20D]
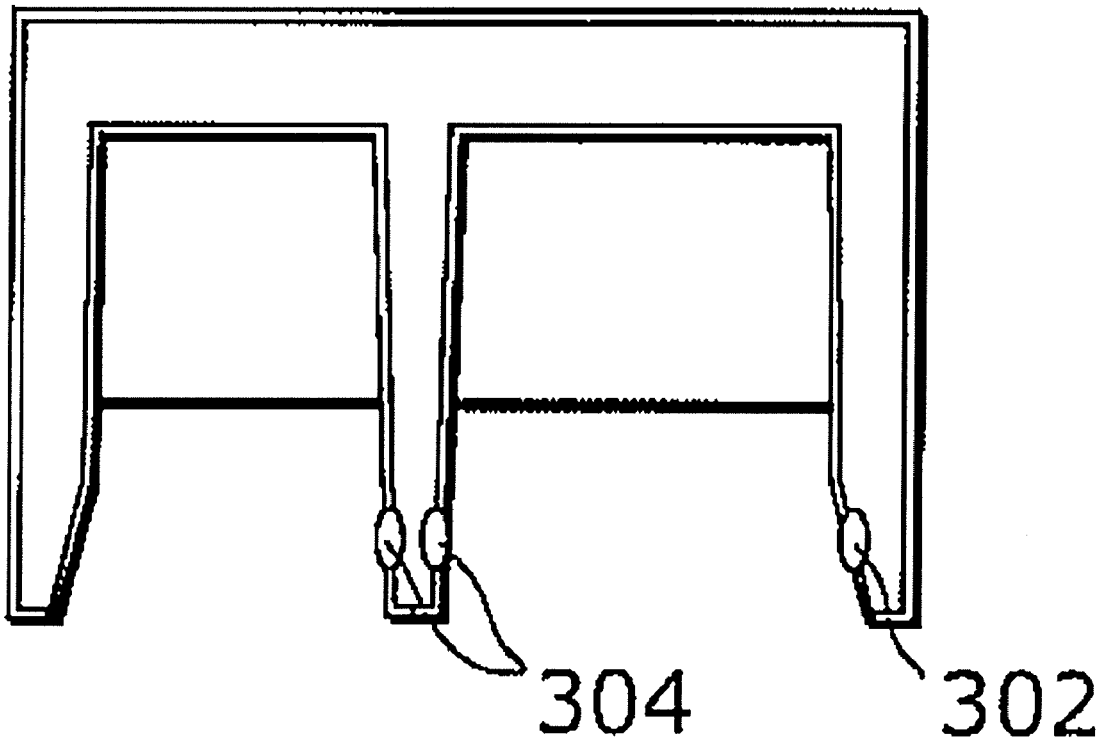

[Fig. 20E]
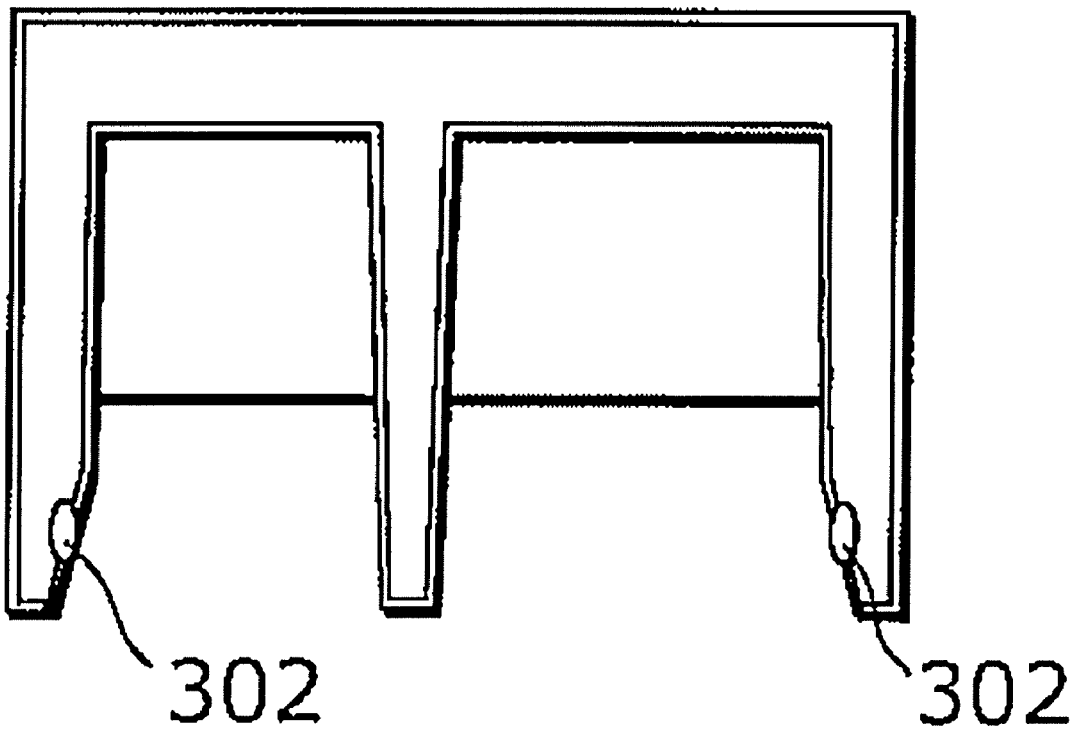
[Fig. 20F]
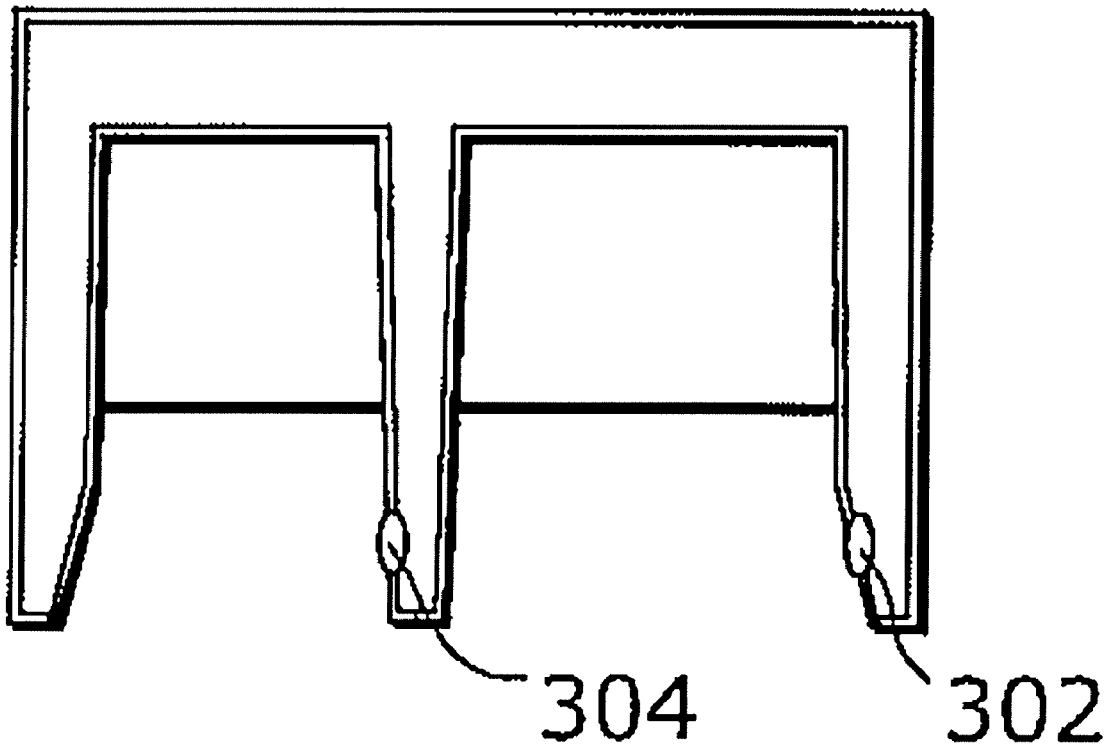

[Fig. 20G]
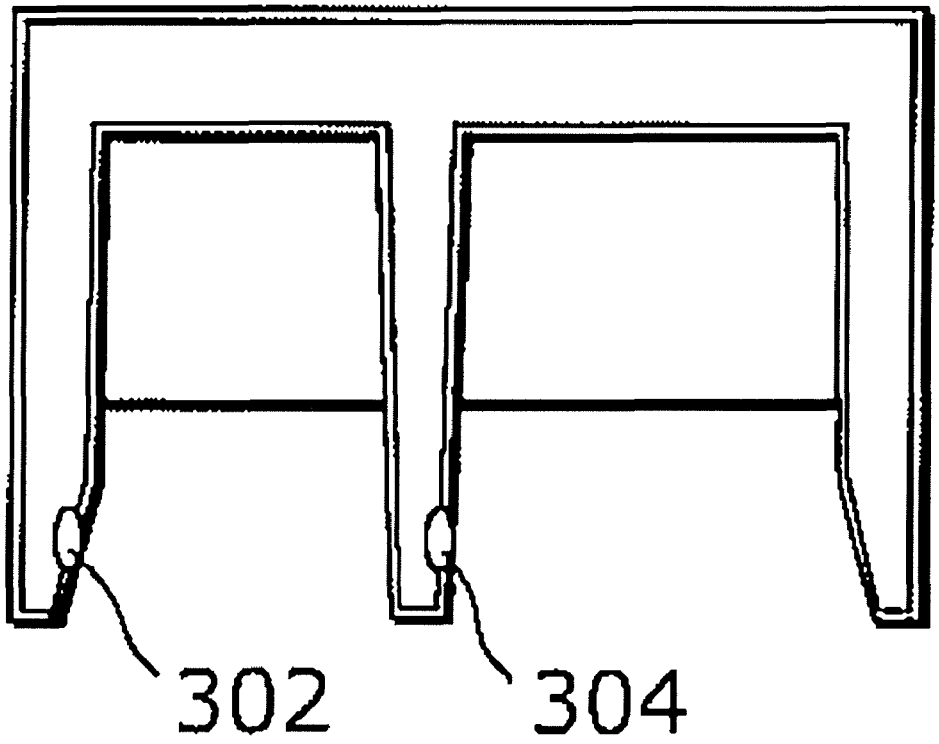
[Fig. 20H]
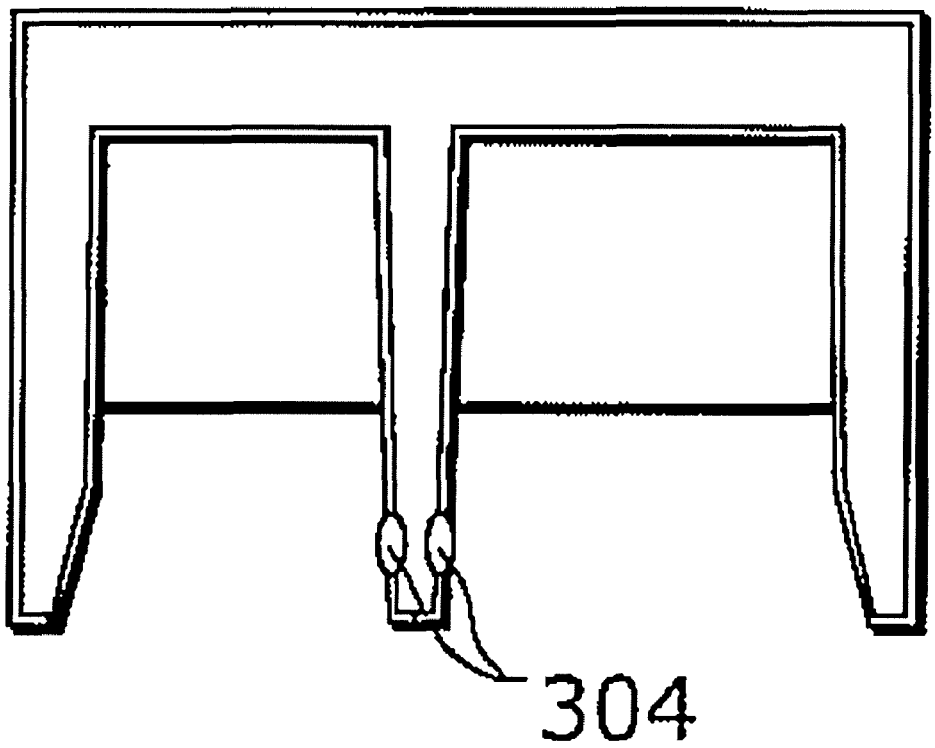

[Fig. 21]
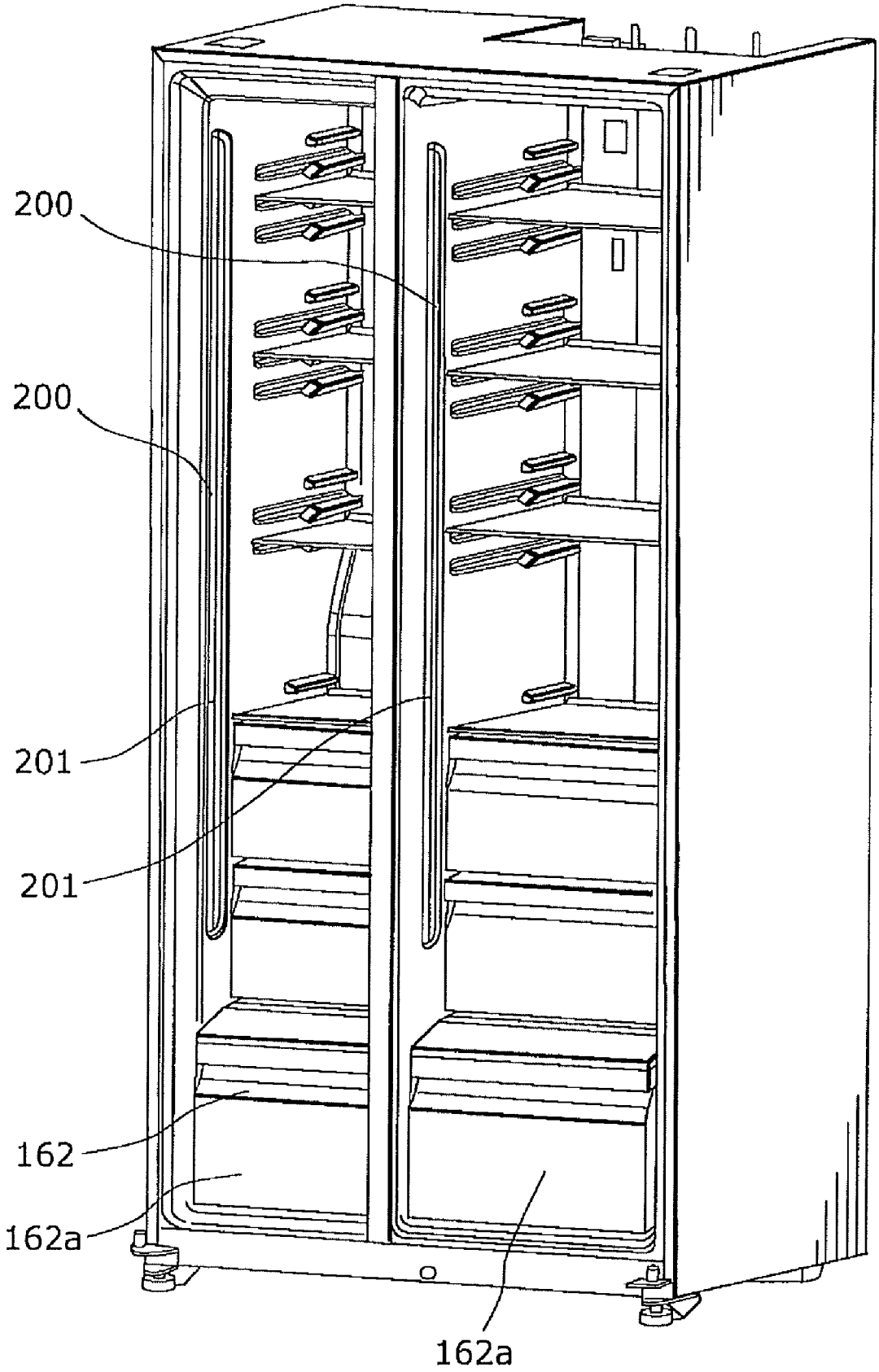

[Fig. 22]
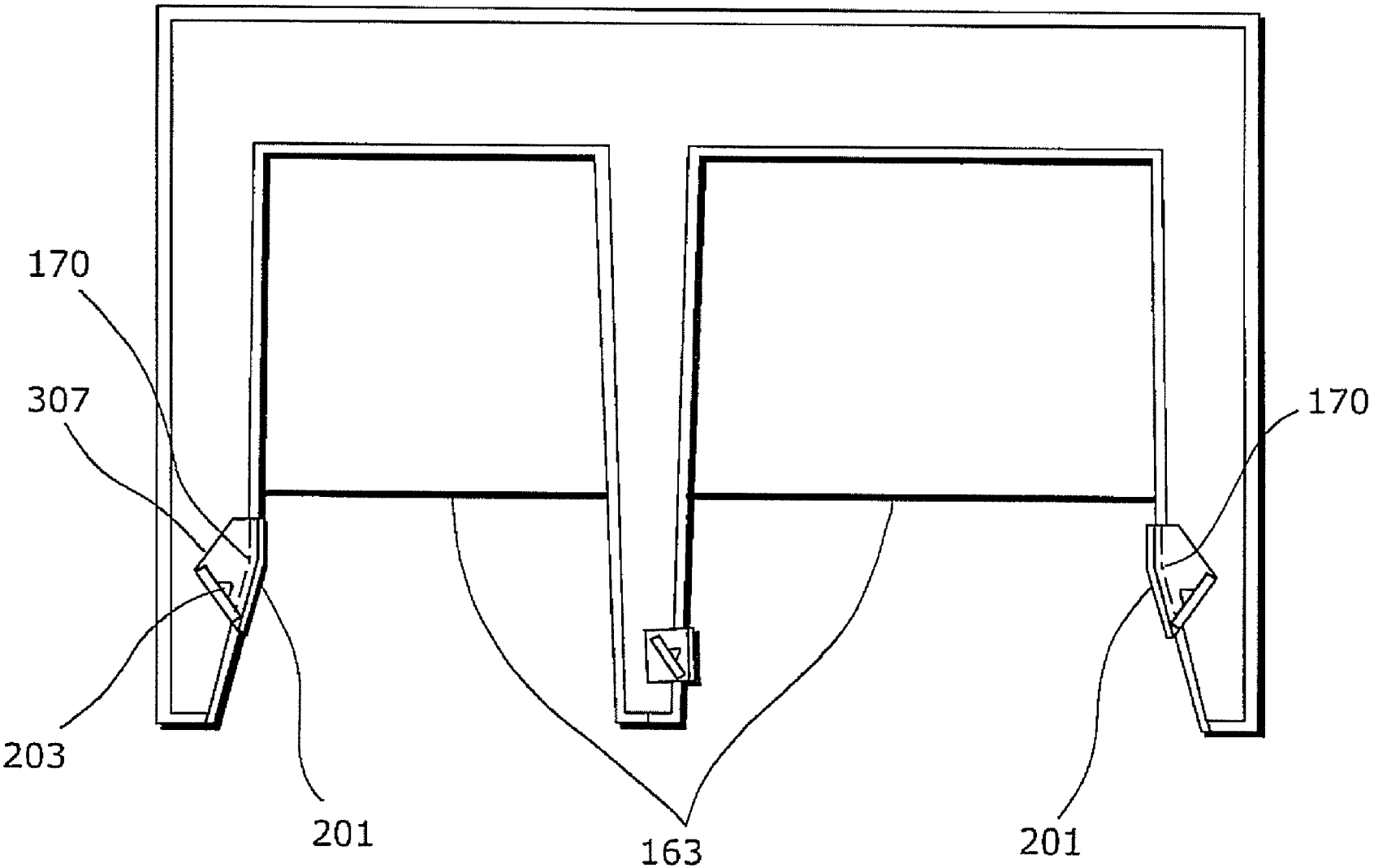

REFRIGERATOR

TECHNICAL FIELD

The present invention relates to a refrigerator having two storage compartments arranged side by side, each having a door opening and closing at the corresponding compartment.

BACKGROUND ART

Conventionally, refrigerators have been provided with lighting units illuminating inside of storage compartments. Recently, lighting units using light-emitting diodes (LEDs) as light sources have been appeared to reduce power consumption or increase a lifetime, as disclosed in Japanese Unexamined Patent Application Publication No. 2005-344975, for example.

However, the lighting units provided in the conventional refrigerators have been arranged on center parts of ceilings, on internal rear walls, or the like. Taking in and out storage items that are to be and have been stored in the refrigerators, users recognize the storage items look dark. Such an illuminated state is enough to allow the users to recognize kinds and the like of the storage items in the refrigerators, but prevents the users to check freshness and the like of the storage items.

SUMMARY OF INVENTION

Technical Problem

In order to address the above-described drawback, researches and experiments have been conducted to discover that the users have seen the storage items look dark, because the lighting units arranged at center parts of ceilings, on internal rear walls, or the like do not directly illuminate sides of the storage items which the users can see, in other words, front sides of the storage items.

Further endeavors and experiments have resulted in discovery of positions of the lighting units to directly illuminate the front sides of the storage items.

Solution to Problem

The present invention is based on the above observations. It is an object of the present invention to provide a refrigerator where a user of the refrigerator can recognize storage items stored therein look bright when viewing the storage items.

In accordance with an aspect of the present invention for achieving the object, there is provided a refrigerator including: a heat-insulating main body having openings in a front side; and a divider creating a first storage compartment and a second storage compartment, by dividing inside of the heat-insulating main body into the first storage compartment and the second storage compartment arranged side by side, and the refrigerator being characterized by further including lighting units, located close to the openings of the first and second storage compartments, respectively, each of which has a light-emitting diode as a light source.

With the above structure, the lighting unit can emit light from the opening towards an internal rear side of the storage compartment. That is, the lighting unit can illuminate directly sides of storage items which a user of the refrigerator can see. As a result, the user can recognize the storage items look bright, when viewing the storage items. In addition, the user can see the light directly incident on the storage items, so that the user can check conditions (freshness, for example) of the storage items.

It is preferable that the refrigerator is characterized by further including attachments, provided vertically at a plurality of positions on an internal side wall of the heat-insulating main body, each of which supports a shelf to be attached, wherein one of the lighting units is provided at the internal side wall of the heat-insulating main body, and arranged in front of the attachments to be overlapped with the attachments in a height direction.

With the above structure, even if the shelf is set using the attachments, the lighting unit can directly illuminate storage items placed and stored on the shelf. Moreover, storage items placed in a plurality of spaces separated by the shelves can be illuminated using a singe lighting unit, which enables the user to see the storage items in all spaces look bright.

It is still preferable that each of the lighting units has boards on each of which a plurality of the light-emitting diodes are provided, and the boards are arranged in a vertical line.

With the above structure, a length of a board included in the lighting unit can be shortened, which makes it possible to suppress bending of the board caused by temperature changed, as much as possible. As a result, soldering cracks resulting from the bending or the like can be prevented, which increases a lifetime of the lighting unit.

In addition, it is possible to improve workability in manufacturing the lighting unit, equipping the lighting units to the refrigerator, and the like.

It is further preferable that the lighting unit provided in the first storage compartment has a vertical length equal to a vertical length of the lighting unit provided in the second storage compartment, and is arranged at a level equal to a level of the lighting unit provided in the second storage compartment.

With the above structure, shapes of the lighting units provided in the refrigerator can be uniformed, which makes it possible to facilitate standardization of components used in the lighting units, thereby reducing a cost. In addition, the above structure can improve design of the lighting units.

It is still further preferable that at least one of the lighting units is arranged to occupy more than a half of a width of a ceiling of the first storage compartment.

With the above structure, the lighting unit can illuminate the storage items from a position higher than a user's eye level and also illuminated the storage items in a wide range. As a result, this gives the user impression that inside of the refrigerator is bright.

It is still further preferable that the refrigerator is characterized by further including attachments, provided vertically at a plurality of positions on the divider, each of which supports a shelf to be attached, wherein one of the lighting units is provided at a side surface of the divider, and arranged in front of the attachments to be overlapped with the attachments in a height direction.

With the above structure, being provided on the divider, the lighting unit can illuminate inside of the storage compartment without influencing the heat-insulating main body insulating the storage compartments from outside air. For example, electric cables necessary for the lighting unit can be wired inside the divider, which makes it possible to suppress influence the lighting unit gives to the heat-insulating main body. In addition, the influence the lighting unit gives to the heat-insulating main body can be suppressed, especially when the lighting unit is buried in the divider.

Furthermore, even if the shelf is set using the attachments, the lighting unit can directly illuminate items placed and stored on the shelf. Moreover, storage items placed in a plurality of spaces separated by the shelves can be illuminated by a singe lighting unit, which enables the user to see the storage items in all spaces look bright.

It is still further preferable that the refrigerator is characterized by further including: a first door opening and closing at the first storage compartment; a second door opening and closing at the second storage compartment; a through hole, provided in the first door, through which an item passes; a third door opening and closing at the through hole; a detection unit configured to detect an open state and a closed state of the third door; and a control unit configured to cause the lighting unit provided in the first storage compartment to turn on, when the detection unit detects the closed state.

With the above structure, storage items that are to be stored and have been stored in the first storage compartment can be taken in and out, without opening and closing the first door having a large size. As a result, it is possible to prevent cool air from being leaked from the storage compartment in opening and closing of the door, which results in energy saving.

In addition, opening of the third door causes the lighting unit in the first storage compartment to light on, which enables the user to take in and out storage items seeing the storage items look bright and to check conditions of the storage items.

It is still further preferable that an upper end of the lighting unit is higher than an upper end of the thorough-hole, and a lower end of the lighting unit is lower than a lower end of the thorough-hole.

With the above structure, a part of the storage compartment which the user can see through the through hole can be illuminated evenly, so that the user can see the part as being in bright sate. Thereby, even if the user see inside of the storage compartment through the through hole, the user can easily access a desired storage item thereby shortening a time required to open the through-hole. This results in saving energy.

It is still further preferable that the first storage compartment has: one of the lighting units which is arranged at one of the internal side wall of the heat-insulating main body and the divider; and a rear-side lighting unit which is arranged at an internal rear surface of the heat-insulating main body and has a light-emitting diode as a light source, and the lighting unit is not overlapped with the rear-side lighting unit in a height direction.

With the above structure, the first storage compartment can be illuminated evenly, without excess illumination.

It is still further preferable that a color of light emitted by the lighting unit provided in the first storage compartment is different from a color of light emitted by the lighting unit provided in the second storage compartment.

With the above structure, the user can surely recognize a difference between the first and second storage compartments, which reduces mistakes such as storing items to be frozen into a refrigerator compartment.

It is still further preferable that intensity of light emitted by the lighting unit provided in the first storage compartment is different from intensity of light emitted by the lighting unit provided in the second storage compartment.

With the above structure, the user can surely recognize a difference between the first and second storage compartments, which reduces mistakes such as storing items to be frozen into a refrigerator compartment.

It is still further preferable that the light-emitting diode in each of the lighting units has a light axis oblique towards an internal rear side of the heat-insulating main body.

With the above structure, more than a half of light that is emitted from the LED and then diffused can directly reach inside of the storage compartment. As a result, the storage items can be illuminated efficiently even with low power consumption.

It is still further preferable that the refrigerator is characterized by further including attachments, provided vertically at a plurality of positions on an internal side wall of the heat-insulating main body, each of which supports a shelf to be attached, wherein the light-emitting diode in one of the lighting units is arranged at a level corresponding to a level of a position between the attachments positioned side by side.

With the above structure, the storage items can be illuminated efficiently, while suppressing influence of the shelves equipped using the attachments.

It is still further preferable that the refrigerator is characterized by further including a drawer in the heat-insulating main body, wherein one of the lighting units is arranged in front of the drawer provided in the heat-insulating main body, and has a lower end lower than an upper end of the drawer or has an upper end higher than a lower end of the drawer.

With the above structure, it is possible to illuminate the storage items stored in the drawer being slid out.

It is still further preferable that a front side of the drawer is made of a plate through which light passes.

With the above structure, it is possible to illuminate the storage items stored in the drawer not being slid out. As a result, the user can see the storage items without sliding out the drawer.

ADVANTAGEOUS EFFECTS OF INVENTION

Thus, according to the present invention, it is possible to suppress shadows on front sides of the storage items which the user sees, which improves visibility of the storage items. Therefore, the present invention achieves usability improvement, reduction in a time required to take storage items in and out, and also energy saving.

BRIEF DESCRIPTION OF DRAWINGS

FIG. 1 is an external perspective view of a refrigerator according to an embodiment of the present invention.

FIG. 2 is an external perspective view of the refrigerator with third and fourth doors open.

FIG. 3 is an external perspective view of the refrigerator with first and second doors open.

FIG. 4 is an external perspective view of the refrigerator not showing the first and second doors.

FIG. 5 is a partially cut-out front view of a lighting unit provided at a side wall of a heat-insulating main body.

FIG. 6 is a cross-sectional view of the lighting unit taken along line A-A of FIG. 5.

FIG. 7 is a cross-sectional view of other lighting units provided at a divider.

FIG. 8 is a perspective view of the heat-insulating main body, viewing a ceiling of the main body from a lower position.

FIG. 9 shows diagrams illustrating how the third door is electrically cooperated with the lighting unit.

FIG. 10 is a cross-sectional view of a refrigerator according to another embodiment, not showing first and second doors.

FIG. 11 is a perspective view of a refrigerator not showing first and second doors, according to still another embodiment of the present invention.

FIG. 12 is a cross-sectional view of a main part of the refrigerator shown in FIG. 11.

FIG. 13 is an exploded perspective view of an inner body 501 and bases each of which serves as a LED attachment.

FIG. 14 is an exploded perspective view of a board on which the base and the LEDs are embedded.

FIG. 15 is a schematic cross-sectional view of an arrangement of the LEDs.

FIG. 16 is a detail view of a part (a) surrounded by a dotted line in FIG. 15.

FIG. 17 is a detail view of a part (b) surrounded by a dotted line in FIG. 15.

FIG. 18 is a perspective view of boards on which LEDs are embedded, bases, and covers.

FIG. 19 is a vertical cross-sectional view of FIG. 18.

FIG. 20A is a cross-sectional view of a refrigerator.

FIG. 20B is a cross-sectional view of a refrigerator.

FIG. 20C is a cross-sectional view of a refrigerator.

FIG. 20D is a cross-sectional view of a refrigerator.

FIG. 20E is a cross-sectional view of a refrigerator.

FIG. 20F is a cross-sectional view of a refrigerator.

FIG. 20G is a cross-sectional view of a refrigerator.

FIG. 20H is a cross-sectional view of a refrigerator.

FIG. 21 is a perspective view of a refrigerator with first and second doors open.

FIG. 22 is a cross-sectional view of a refrigerator.

DESCRIPTION OF EMBODIMENTS

The following describes preferred embodiments according to the present invention with reference to the drawings FIG. 1 is an external perspective view of a refrigerator according to an embodiment of the present invention.

FIG. 2 is another external perspective view of the refrigerator with third and fourth doors open.

As shown in FIGS. 1 and 2, a refrigerator 100 of the present invention includes a heat-insulating main body 150, a first door 111, a second door 121, a third door 112, a through hole 113, a third door 112, and a fourth door 122.

The heat-insulating main body 150 is a main body with a front side being opened.

The heat-insulating main body 150 consists of an outer box 500 commonly made of a steel sheet, an inner box 501 commonly made of resin, and foam insulation 502 such as urethane filled between the outer box 500 and the inner box 501, thereby having heat insulation properties that shut off heat coming in and out of the refrigerator 100.

The first door 111 opens and closes at an opening on the right-hand side of the heat-insulating main body 150. In the present embodiment, the first door 111 is attached to the heat-insulating main body 150 using a hinge (not shown) so as to turn centering on a vertical axis that extends in an anterior portion of the right-side wall of the heat-insulating main body 150. Furthermore, the first door 111 is rectangular in shape when viewed from the front, with the axis arranged along the right-edge rim of the first door 111.

The second door 121 opens and closes at an opening on the left-hand side of the heat-insulating main body 150. In the present embodiment, the second door 121 is attached to the heat-insulating main body 150 using a hinge (not shown) so as to turn centering on a vertical axis that extends in an anterior portion of the left-side wall of the heat-insulating main body 150. Furthermore, the second door 121 is rectangular in shape when viewed from the front, with the axis arranged along the left-edge rim of the second door 121.

Here, the second door 121 has a width shorter than a width of the first door 111.

The through hole 113 is a hole penetrating the first door 111 in the thickness direction. The through hole 113 is a hole through which the user can take storage items out from a space behind the first door 111 without opening the first door 111, or take storage items into the space behind the first door 111 to be stored.

The third door 112 opens and closes at the through hole 113. In the present embodiment, the third door 112 is attached to the first door 111 using a hinge (not shown) so as to turn centering on a horizontal axis located at a lower-edge rim of the through hole 113. Furthermore, the third door 112 is a substantially square in shape (round-cornered) from viewed from the front, with the axis arranged along the lower-edge rim of the third door 112.

The fourth door 122 opens and closes at a dispenser 123 where a user receives ice or the like supplied from inside of the refrigerator 100.

FIG. 3 is an external perspective view of the refrigerator with the first and second doors open.

FIG. 4 is another external perspective view of the refrigerator not showing the first and second doors.

As shown in FIGS. 3 and 4, the refrigerator 100 includes a divider 153, lighting units 200, rear-side lighting units 250, attachments 161, and drawers 162. In addition, shelves 163 are attached using the corresponding attachments 161.

The divider 153 is a wall separating inside of the heat-insulating main body 150 side by side. In the present embodiment, a right-hand part of the heat-insulating main body 150 divided by the divider 153 is a first storage compartment 151 serving as a refrigerator compartment. On the other hand, a left-hand part of the heat-insulating main body 150 divided by the divider 153 is a second storage compartment 152 serving as a freezer compartment. The divider 153 separates the refrigerator compartment and the freezer compartment, providing heat insulation between the compartments.

The attachments 161 are members provided on internal side walls of the heat-insulating main body 150 and on side surfaces of the divider 153, protruding from the walls and the surfaces. In the present embodiment, each of the attachments 161 is a rail-shaped member arranged horizontally from a front side to an internal rear side of the heat-insulating main body 150, and integrated to the heat-insulating main body 150 or the divider 153. Here, FIG. 3 shows only some of the attachments 161 that are provided on the heat-insulating main body 150 of the first storage compartment 151, and FIG. 4 shows other attachments 161 that are provided on the divider 153 and on the heat-insulating main body 150 of the second storage compartment.

Each of the shelves 163 is a board bridging between an attachment 161 on the internal side wall of the heat-insulating main body 150 and an attachment 161 on the side surface of the divider 153. The shelf 163 can slide in and out along the attachments 161. The shelf 163 has enough strength to hold storage items placed thereon, being supported by the attachments 161. The shelf 163 is made of anything, but preferably a material through which light passes. For example, the shelf 163 may be made of a glass or a transparent resin, or may be made of a material having holes through which light passes, such as a metal mesh or a perforated metal sheet.

The drawer 162 is a container without a top, provided in the heat insulating main body 150, and can be slides in and out. In the present embodiment, the first storage compartment has three drawers 162, and the second storage compartment 152 also has three drawers 162.

The drawers 162 in the first storage compartment 151 are arranged vertically. Each of the upper two drawers in the first storage compartment 151 has a width corresponding to a full width of the first storage compartment 151, and has a depth approximately equal to a depth of the shelf 163. The bottom drawer 162 in the first storage compartment 151 has a width corresponding to a full width of the first storage compartment 151, and has a depth greater than the depth of the upper drawers 162 but approximately equal to a depth of the inside of the heat-insulating main body 150.

The drawers 162 in the second storage compartment 152 are arranged vertically.

Every drawer 162 in the second storage compartment 152 has a width corresponding to a full width of the first storage compartment 151, and has a depth approximately equal to a depth of the inside of the heat-insulating main body 150.

Each of these drawers 162 is made of anything, but preferably a material through which light passes. For example, at least a front part of the drawer 162 is preferably a plate body made of a glass, a transparent resin, or the like. In the present embodiment, each drawer 162 is an integrally molded container made of a transparent resin. This allows light to pass through the drawer 162, thereby maintaining humidity in the drawer 162.

Each of the lighting units 200 is a lighting device having LEDs as light sources. The lighting units 200 are located close to the openings of the first storage compartment 151 and the second storage compartment 152. In the present embodiment, the lighting units 200 are provided at the side walls of the heat-insulating main body 150 close to the openings of the heat-insulating main body, and at the divider 153 close to the openings of the heat-insulating main body.

Here, the expression "close to" means that each lighting unit 200 is located at a position in front of front ends of the shelves 163 and also behind the front ends of the heat-insulating main body 150 when the shelves 163 are arranged in the heat-insulating main body 150.

FIG. 5 is a partially cut-out front view of the lighting unit provided at the side wall of the heat-insulating main body.

FIG. 6 is a cross-sectional view of the lighting unit taken along line A-A of FIG. 5.

FIG. 7 is a cross-sectional view of other lighting units provided at the divider.

As shown in FIGS. 5, 6, and 7, each of the lighting units 200 has a cover 201, boards 202, LEDs 203, and connectors 204. Moreover, the lighting units 200 at the side walls of the heat-insulating main body 150 are accommodated in recess parts 154 provided in the side walls, respectively. On the other hand, other lighting units 200 at the divider 153 are accommodated in recess parts 154 provided in both side surfaces of the divider 153, respectively. Therefore, the lighting units 200 at the divider 153 are located back to back. When the lighting units 200 are buried in the divider 153, the divider 153 has thin parts. However, the divider 153 does not need to have heat insulation properties as high as the heat insulation properties of the heat-insulating main body 150. Therefore, the divider 153 is a suitable place in which the lighting units are to be buried.

Each of the lighting units 200 is provided upright to be overlapped, in a height direction, with the attachments 161 vertically arranged at a plurality of positions. In other words, an upper end of the lighting unit 200 is higher than a predetermined attachment 161, and a lower end of the lighting unit 200 is lower than other attachments 161 below the predetermined attachment 161. In the present embodiment, the lower end of the lighting unit 200 is lower than a lower end of the top drawer 162, and also lower than an upper end of the middle drawer 162.

As shown in FIG. 5, the lighting unit 200 in the first storage compartment has an upper end that is higher than an upper end of the through hole 113, and a lower end that is lower than an lower end of the through hole 113.

The cover 201 is a plate body having a function of protecting the LEDs 203 and the boards 202 from air in the first or second storage compartment 151 or 152, and also a function of causing light emitted by the LED 203 to pass through the cover 201. The cover 201 prevents electric troubles caused when air in the first or second storage compartment 151 or 152 directly contacts the LEDs 203 and the boards 202 thereby being changed to dew condensation. In the present embodiment, the cover 201, with a part applied with texturing, has a function of illuminating the first or second storage compartment 151 or 152 using light emitted from the LED 203 and refracted at random.

Each of the boards 202 is a board body which holds a plurality of the LEDs 203 and on which wiring is printed to connect the LEDs 203 to a power source and the like. In the present embodiment, the board 202 is a rectangular, and the LEDs 203 are arranged in a line in a longitudinal direction of the board 202. Furthermore, in the longitudinal direction, the board 202 has one end connected to a female connector 204, and the other end connected to a male connector 204.

The board 202 can be connected with a different board 202, by connecting its female connector 204 to a male connector 204 of the different board 202. In the present embodiment, the lighting unit 200 has a plurality of such boards 202 connected with one another arranged in a vertical line. Furthermore, the connecting part of each board 202 is arranged at a level equal to a level of the corresponding pair of attachments 161. As explained above, by arranging the connecting part of the board 202, the LEDs 203 can be located at appropriate positions.

Moreover, as shown in FIG. 6, the board 202 faces a direction different from a direction to which the side wall of the heat-insulating main body 150 faces, so that a side of the board 202 with the LEDs 203 can be seen when viewing from the internal rear side of the heat-insulating main body 150 toward the front side. With the above structure, a more amount of light can be emitted from the front side to the internal rear side of the heat-insulating main body 150, thereby illuminating the storage items brightly.

Each of the LEDs 203 is a semiconductor device that emits light when electric current flows through the LED 203. In the present embodiment, the LED 203 has a plurality of semiconductor devices that can emit white light. The LEDs 203 in the first storage compartment 151 and the second storage compartment 152 are different semiconductor devices so that they emit light having different emission colors. In more detail, the LEDs 203 in the first storage compartment 151 are adjusted to emit light having orangish white color, and the LEDs 203 in the second storage compartment 152 are adjusted to emit light having bluish white color. Further, by adjusting emission light of the LEDs 203 as described above, the user feels that the second storage compartment 152 is slightly darker than the first storage compartment 151. Furthermore, in the present embodiment, by slightly reducing a power amount supplied to the LEDs 203 in the second storage compartment 152, the user feels that the storage compartment 152 is much darker.

The LED 203 is arranged not to be at a level equal to a level of the attachments 161, when the board 202 is provided at the heat-insulating main body 150 or the divider 153. In addition, the LED 203 is arranged not to be at a level equal to a level of each shelf 163 supported by the attachments 161.

The LED 203 is arranged so that a light axis 231 (shown in FIG. 6) is oblique towards the internal rear side of the heat-insulating main body 150. Here, the light axis 231 is a virtual axis representing a direction of light emitted by the LED 203, and is a line from the LED 203 and a position from which the LED 203 is seen to have the strongest brightness.

It should be noted that the adjustment of color or darkness of the light emitted by the lighting unit 200 many be achieved not only by adjusting the LEDs 203, but also by changing a material or a shape of the cover 201.

A rear-side lighting units 250 is also provided as a lighting device having LEDs as light sources, and provided at the internal rear wall of the heat-insulating main body 150 of the first storage compartment 151. The rear-side lighting unit 250 is buried in the internal rear wall of the heat-insulating main body 150.

As shown in FIG. 4, a lower end of the rear-side lighting unit 250 is located lower than the upper ends of the lighting units 200 in the first storage compartment 151.

FIG. 8 is a perspective view of the heat-insulating main body, viewing the ceiling of the heat-insulating main body from a lower position.

As shown in FIG. 8, the refrigerator 100 has another lighting unit 200 on a ceiling part 155.

The lighting unit 200 on the ceiling is arranged to occupy more than a half of a horizontal width of the ceiling part 155 of the first storage compartment 151, and located close to the opening of the heat-insulating main body 150.

FIG. 9 shows diagrams illustrating how the third door is electrically cooperated with the lighting unit.

As shown in FIG. 9, the refrigerator 100 includes a detection unit 141 and a control unit 140.

The detection unit 141 is a sensor that detects an open state and a close state of the third door 112. In the present embodiment, a micro switch is used as the detection unit 141. Therefore, the detection unit 141 is switched on when the third door 112 is closed, and the detection unit 141 is switched off when the third door 112 is opened.

The control unit 140 is a device that detects a state of the detection unit 141, and causes the lighting units in the first storage compartment 151 to turn on when the detection unit 141 becomes in a predetermined state. In the present embodiment, the control unit 140 causes the lighting unit 200 to turn off when the detection unit 141 is in the ON state, and causes the lighting unit 200 to turn on when the detection unit 141 is in the OFF state.

Next, a refrigerator 100 according to another embodiment of the present invention is described.

FIG. 10 is a cross-sectional view of the refrigerator not showing first and second doors, according to this embodiment.

As shown in FIG. 10, the refrigerator 100 of this embodiment differs from the refrigerator 100 of the previously-described embodiment in that the lower end of the rear-side lighting unit 250 is higher than the upper end of the lighting units 200 in the first storage compartment 151. In other words, the rear-side lighting unit 250 is not overlapped with the lighting units 200 in a height direction.

FIG. 11 is a perspective view of a refrigerator not showing first and second doors, according to still another embodiment of the present invention. FIG. 12 is a cross-sectional view of a main part of the refrigerator shown in FIG. 11.

As shown in FIG. 11, the first storage compartment 151 serving as a refrigerator compartment and the second storage compartment 152 serving as a freezer compartment are arranged side by side, and as shown in FIG. 12, a lighting unit 302 is located close to an opening of a side surface wall part 301 of a heat-insulating main body 300 that is a side wall of the first storage compartment 151.

Furthermore, as shown in FIG. 12, a lighting unit 304 is located close to an opening of a divider side surface part 303 that is an inside surface of a side wall of the first storage compartment 151 and is a part of a divider 153 arranged between the first storage compartment 151 and the second storage compartment 152.

As shown in FIG. 12, another lighting unit 302 is located close to an opening of a side surface wall part 301 of the heat-insulating main body 300 which is a side wall of the second storage compartment 152 serving as the freezer compartment.

Since a width dimension (left-to-right) of the first storage compartment 151 is greater than a width dimension of the second storage compartment 152, the lighting units are provided on both side surface wall parts of the first storage compartment 151, so that the inside of the first storage compartment 151 can be illuminated brightly by emitting light from the both sides. On the other hand, since the width dimension of the second storage compartment 152 is smaller than the width dimension of the first storage compartment 151, the lighting units are provided only on the side surface wall part 301 to illuminate the inside of the second storage compartment 152. Since no lighting unit is provided on the divider side surface part dividing the second storage compartment 152 from the first storage compartment 151 for illuminating the inside of the second storage compartment 152, the divider 153 can obtain a thickness enough to improve heat insulation properties.

Furthermore, a top level of each of the lighting units 302 and 304 provided on both wall parts of the first storage compartment 151 is equal to a top level of the lighting unit 302 provided on the wall part 301 of the second storage compartment 152. In more detail, a plurality of the lightning units are vertically and sequentially arranged on each wall part. A bottom level is also equal among the set of the lighting units 302 in the first storage compartment 151, the set of the lightning units 304, and the set of the lightning units 302 in the second storage compartment 152.

A plurality of the LEDs 203, which are light sources of each of the lighting units 302 and 304, are vertically arranged in each of the lightning units. While the top and bottom levels are equal among the lightning units 302 and the lightning unit 304, a level of each of the LEDs 203 is also equal among the lightning units 302 and the lightning unit 304.

The LEDs thereby light up and emit light at the respective equal levels between in the first storage compartment 151 and in the second storage compartment 152. Therefore, when both the first and second doors are open, the LEDs 203 light up at the respective equal levels between in the first storage compartment 151 and in the second storage compartment 152. As a result, design in lightning can be improved and storage items can be effectively illuminated.

FIG. 13 is an exploded perspective view of an inner body 501 and bases on each of which LEDs are attached. FIG. 14 is an exploded perspective view of a board on which the base and the LEDs are embedded. FIG. 15 is a schematic cross-sectional view of an arrangement of the LEDs. FIG. 16 is a detail view of a part (a) surrounded by a dotted line in FIG. 15. FIG. 17 is a detail view of a part (b) surrounded by a dotted line in FIG. 15.

Moreover, a tapered surface 301*a* is provided at each of front edge parts close to respective openings of the side surface wall parts 301 of the first storage compartment 151 and the second storage compartment 152, so that a frontage of each of the openings is flaring. On the other hand, a tapered surface 153*a* is provided at a front edge part of the divider 153. Assuming that the tapered surface 301*a* provided at the side surface wall part 301 has an angle THETA1 and the tapered surface 153*a* provided at the divider 153 is an angle PHI1, a relationship between the angle THETA1 and the angle PHI1 is determined by the following Equation 1.

$$\theta 1 \geqq \phi 1 \quad \text{(Equation 1)}$$

The lighting units 302 and 304 are embedded in the heat-insulating main body 300. More specifically, openings 305 are provided to each of the tapered surfaces 153*a* and 301*a* of the inner body 501 which are parts of internal walls of the refrigerator, and a base 306 for fixing the board 202 having the LEDs 203 is arranged in each of the openings 305, being embedded in the internal wall.

Since the LEDs 203 have directionality, when the board 202 is provided in the opening 305, the board 202 needs to be arranged inside the opening 305 so that an illumination direction of the LEDs 203 can be set towards the rear side of the inside of the first storage compartment 151. Therefore, the board 202 fixed on the base 306 in the opening 305 is not arranged in parallel to the tapered surface 301*a*. In more detail, the board 202 is fixed by a fixing part 306*a* provided on the base 306 so that an illumination direction of the LEDs 203 can be set towards the internal rear side of the first storage compartment 151.

The LEDs 203 same as above are used also in the lighting unit 304. The board 202 arranged in the opening 305 that opens towards the tapered surface 153*a* is fixed by a fixing part 307*a* provided on a base 307, so that an illumination direction of the LEDs 203 can be set towards the internal rear side the first storage compartment 151.

Since the angle THETA1 of the tapered surface 301*a* is greater than the angle PHI1 of the tapered surface 153*a*, an angle between the tapered surface 301*a* and the board 202 fixed by the fixing part 306*a* on the base 306 is set to be greater than an angle between the tapered surface 153*a* and the board 202 fixed by the fixing part 307*a* on the base 307.

The LEDs 203 of the lighting unit 302 provided in the tapered surface 301*a* of the second storage compartment 152 has the arrangement same as described above.

Moreover, a light axis of the LED 203 of the lighting unit 302 is towards the center of a front surface of the corresponding shelf 163 in the first storage compartment 151.

Therefore, if the angle THETA of the tapered surface 301*a* is greater than the angle PHI of the tapered surface 153*a*, an angle between the tapered surface 301*a* and the board 202 embedded in the tapered surface 301*a* is set to be greater than an angle between the tapered surface 153*a* and the board 202 embedded in the tapered surface 153*a*, thereby brightly illuminating the inside of the first storage compartment 151.

It is also possible that the light axis of the LED 203 of the lighting unit 302 is set towards the rear part of the divider side surface part 303 in the first storage compartment 151 and the light axis of the LED 203 of the lighting unit 304 is set towards the rear part of the side surface wall part 301 in the first storage compartment 151, thereby illuminating the internal rear part of the first storage compartment 151 by reflecting the light axis on the rear parts.

By reflecting light on the side walls, it is possible to illuminate the inside of the first storage compartment 151 up to the internal rear part.

It should be note that the base 306 provided in the tapered surface 301*a* can also be used in the tapered surface 153*a*. If the angle THETA1 is greater than the angle PHIL the light axis of the LED 203 is set by arranging the board 202 to be significantly oblique according to the base 306 in the tapered surface 301*a*. Therefore, an irradiation angle of the light axis of the LED 203 provided in the tapered surface 301*a* is different from the irradiation angle of the light axis of the LED 203 provided in the tapered surface 153*a*. However, both the lighting units 302 and 304 can be provided with the LEDs 203 to illuminate the inside of the first storage compartment 151, so that the base can be shared between the tapered surfaces 301*a* and 153*a*.

FIG. 18 is a perspective view of the boards on which the LEDs are embedded, the bases, and the covers. FIG. 19 is a vertical cross-sectional view of FIG. 18.

A plurality of the openings 305 in each of which the board 202 on which a plurality of the LEDs 203 are embedded at equal spaces is embedded are vertically arranged with spaces by forming holes in the heat-insulating main body 300. Therefore, there are a plurality of the boards 202 arranged for the plurality of the openings 305. A plurality of the covers 201 that are transparent, each of which covers the LEDs 203 and the board 202, are arranged in association with the plurality of the openings 305, respectively. Here, the end part of the cover 201 overlaps with the end part of the different cover 201. As a result, a single integrated vertical space covered by the covers 201 is formed.

Thereby, the plurality of the openings 305 are vertically arranged at regular intervals in the inner body 501, the plurality of the bases 307, each of which is in association with corresponding one of the openings 305, are arranged in a line, each having top and bottom end parts overlapped with top and bottom end parts of other bases 307. Each of the plurality of the bases 202 which are arranged at regular intervals is arranged in association with corresponding one of the openings 305. Each of the covers 201 is provided on the base 202 to cover the LEDs 203. The plurality of covers 201 are arranged in a line, overlapping with each other at the top and bottom end parts.

Thereby, since the vertically-arranged bases 307 are partially overlapped with one another, a heat-insulating material forming the heat-insulating main body 300 does not enter a space 401 between the bases 307 and the covers 201. Since the covers 201 are connected with one another being overlapped with one another, the vertically integrated space 401 can be formed, which makes it possible to illuminate the storage compartment from the space 401 via the continuously arranged covers 201 when the LEDs 203 light up.

Each of the overlapped parts of the covers 201 has an uneven part 201*a* which prevents unevenness where the covers 201 overlaps each other. As a result, a flat surface of the integrated cover of the overlapped covers 201 can be achived. Thereby, the storage compartment can be illuminated without shadow caused by the overlapped parts when the LEDs 203 light up.

Each of the transparent covers 201 is made of resin. Since the plurality of the covers 201 are vertically connected to be a lightning cover, for the same reasons as the arrangement of the vertically-arranged boards 202, warpage and deformation of the covers 201 can be prevented, component delivery and manufacturing assembly can be easily handled, and quality in assembly can be controlled.

Furthermore, the LEDs 203 may be arranged in the following manner in order to brightly illuminate the storage compartment.

FIG. 20A is a cross-sectional view of the refrigerator having: (a) the first storage compartment 151 serving as a refrigerator compartment in which the boards 202 having the LEDs 203 are arranged in a height direction of the first storage compartment 151 in side walls of the heat-insulating main body 150, namely in both side walls of the first storage compartment 151, in other words, in both the side surface wall part 301 and the divider 153; and (b) the second storage compartment 152 serving as a freezer compartment in which no LED 203 is arranged. In this case, the freezer compartment has a low temperature of a temperature zone equal to or less than 0 degrees centigrade. Since the LEDs 203 and the boards 202 are located as a place easily exposed to the air outside when the door opens, dew condensation easily occurs, which causes insufficient insulation or the like. Therefore, the LEDs are arranged only in the refrigerator compartment, not in the freezer compartment, so that reliability can be ensured.

FIG. 20B is a cross-sectional view of the refrigerator having: (a) the first storage compartment 151 serving as a refrigerator compartment in which the boards 202 having the LEDs 203 are arranged in a height direction of the first storage compartment 151 in side walls of the first storage compartment 151, in other words, in both the side surface wall part 301 and the divider 153; and (b) the second storage compartment 152 serving as a freezer compartment in which the LEDs 203 are arranged in a height direction of the second storage compartment 152 in the side surface wall part 301 of the second storage compartment 152 and no LEDs 203 are arranged in the divider 153 of the second storage compartment 152. In this case, the LEDs 203 for illuminating the first storage compartment 151 are embedded in the divider 153 in the first storage compartment 151. Therefore, when further LEDs 203 are embedded and arranged in the divider 153 in the second storage compartment 152, a thickness of the divider 153 dividing the first storage compartment 151 from the second storage compartment 152 is partially reduced. Since a thickness of the divider 153 is smaller than a thickness of the side surface wall part 301 in the second storage compartment 152, more flexibility of an arrangement angle of the board 202 having the LEDs 203 can be achieved when the board 202 is embedded and arranged in the side surface wall part 301, which can provide design flexibility. Since a width dimension of the second storage compartment 152 is smaller than a width dimension of the first storage compartment 151, the illumination from a single side wall is enough to brightly illuminate the inside of the second storage compartment 152.

FIG. 20C is a cross-sectional view of the refrigerator that has basically the same structure as that of the refrigerator of FIG. 20B. The structure of FIG. 20C differs from the structure of FIG. 20B in that the board 202 having the LEDs 203 is arranged also in the divider 153 in the second storage compartment 152. At the location close to the opening of the second storage compartment 152, the tapered surface 301*a* having the angle THETA1 is formed in the side surface side wall part 301 and the tapered surface 153*a* having the angle PHI1 is formed in the divider 153. The angle PHI1 is nearly 0 degree. Therefore, the board 202 having the LEDs 203 needs to be embedded in the wall surfaces and arranged obliquely to some extent in order to illuminate the internal rear side of the compartment from the front side.

Especially, it is necessary to set the light axis of the LEDs 203 towards the internal rear side of the storage compartment by setting the board 202 embedded in the tapered surface 301*a* oblique towards the storage compartment more than the board 202 embedded in the tapered surface 153*a*. Thereby, since the thickness of the side surface wall part 301 in the second storage compartment 152 is greater than the thickness of the divider 153, even if the angle of obliquely embedding the board 202 is increased, the board 202 can be arranged in the design to illuminate the internal rear side of the storage compartment.

Since the LEDs 203 are embedded in the side surface wall part 301, even if the second door 121 opening and closing the front side of the second storage compartment 152 has a function device such as an ice maker, it is possible to prevent the cover 201 covering the LEDs 203 from contacting the function device when closing the second door 121. Therefore, there is no need to provide a dead space between the cover 201 and the function device.

The board 202 embedded in the tapered surface 153*a* is arranged having an oblique angle smaller than that of the board 202 in the side surface wall part 301 so as to illuminate the internal rear side of the storage compartment. Therefore, the opening 305 in which the board 202 for the divider 153 is embedded can be smaller than the opening 305 in the side surface wall part 301. As a result, the heat insulation properties of the divider 153 can be ensured.

Each of the first and second storage compartments 151 and 152 can be illuminated from both side walls. Therefore, storage items therein can be brightly illuminated.

FIG. 20D is a cross-sectional view of the refrigerator having: (a) the first storage compartment 151 serving as a refrigerator compartment in which the board having the LEDs are embedded in both side walls of the first storage compartment 151; and (b) the second storage compartment 152 serving as a freezer compartment in which the board having the LEDs are embedded only in the divider 153. With the above structure, the second storage compartment 152 can be brightly illuminated from only one side wall. It is also possible to shorten a length of electric wiring of the board 202 connected to a control board provided in a ceiling part of the refrigerator 100 for controlling the entire refrigerator 100.

FIG. 20E is a cross-sectional view of the refrigerator having: (a) the first storage compartment 151 serving as a refrigerator compartment in which the board 202 having the LEDs 203 are arranged in a height direction of the first storage compartment 151 only in the side surface wall part 301; and (b) the second storage compartment 152 serving as a freezer compartment in which the board 202 having the LEDs 203 are arranged in a height direction of the second storage compartment 152 only in the side surface wall part 301. Each of the first and second storage compartment 151 and 152 is illuminated when the LEDs 203 in the side surface wall part 301 emits light from the front side of the compartment to the rear side of the compartment. Therefore, since the divider 153 does not have the LEDs 203, the divider 153 does not need to have the opening 305 in which the board having the LEDs is embedded. As a result, it is possible to improve the heat insulation properties of the first and second storage compartment 151 and 152.

In general, the refrigerator having doors opening left and right has a relatively smaller width dimension of the first and second storage compartments 151 and 152. When the lighting units 302 are arranged on a side wall of the storage compartment, if the lighting units 302 are arranged vertically only on a single side wall, an effect of illuminating the storage compartment with a certain degree can be obtained in practice. Therefore, there are merits as rational specification required as lightning specification.

As shown in FIG. 20F, if the LEDs 203 are arranged both in the side surface wall part 301 of the first storage compartment 151 and in the divider 153 of the second storage compartment 152, the LEDs 203 emit light in the same direction from the front side of each compartment. Therefore, both of the first and second storage compartments 151 and 152 can be brightly illuminated by setting the same directionality between the light axes. As also shown in FIG. 20G, in the similar manner to FIG. 20F, if the LEDs 203 are arranged both in the divider 153 of the first storage compartment 151 and in the side surface wall part 301 of the second storage compartment 152, both of the first and second storage compartments 151 and 152 can be brightly illuminated by setting the same directionality between the light axes.

As shown in FIG. 20H, if the board 202 having the LEDs 203 is obliquely arranged in each of the divider 153 in the first storage compartment 151 and the divider 153 in the second storage compartment 152, and the light axes are set from the front side of the compartments to the internal rear side of the compartments, thereby illuminating each of the first and second storage compartments 151 and 152 from a single side, it is possible to save energy and also illuminate storage items in the storage compartments.

In this case, the lighting units 304 having the LEDs 203 are arranged only on both sides of the divider 153 and not arranged in the side walls of the inner body of the main body of the refrigerator. Therefore, the structure such as wiring of the lighting units 304 can be combined and simplified to provide a rational lightning structure. Furthermore, the lighting units 304 are not arranged in the heat-insulating walls of the bosh side walls of the main body of the refrigerator and there is no unevenness on the heat-insulating walls. As a result, the structure has advantages for the surfaces having heat insulation properties.

On the other hand, if, for example, the divider 153 is a structure separate from the inner body 501, there are advantages in manufacturing processes because a process of embedding the lighting units 304 in the divider 153 can be completed previously, and also in gaining a flexibility of sharing the main body of the refrigerator and changing specification of the lighting units for each model.

FIG. 21 is a perspective view of the refrigerator with the first door 111 and the second door 121 open. The inside of the refrigerator is divided into the first storage compartment 151 and the second storage compartment 152 arranged side by side. The first storage compartment serves as a refrigerator compartment, and the second storage compartment 152 serves as a freezer compartment. Each of the first and second storage compartments 151 and 152 has the shelves 163 arranged vertically on each of which food and the like are to be placed. Below the lowest one (bottom shelf) of the shelves 163, there are the drawers 162 arranged vertically. Each of the drawers has a drawer front side 162*a* which is a front side of the drawer. In each of the first and second storage compartments 151 and 152, the drawer front side 162*a* of the lower one (bottom drawer) of the drawers 162 is located ahead towards the opening of the refrigerator 100 more than the drawer front sides 162*a* of the upper ones of the drawers 162. An upper end of the lighting unit 200 having the LEDs 203 is higher than a predetermined attachment 161 by which one of the shelves 163 is attached, and a lower end of the lighting unit 200 is lower than the other attachments 161 below the predetermined attachment 161. In the present embodiment, the lower end of the lighting unit 200 is lower than a lower end of the top drawer 162, also lower than an upper end of the drawer 162 under the top drawer, and higher than an upper end of the bottom drawer 162.

Furthermore, the lighting unit 200 is arranged in front of front ends of the shelves 163 and a front end of the top drawer 162, and behind the drawer front side 162*a* of the bottom drawer 162. Thereby, the LEDs 203 in the lighting unit 200 can illuminate the shelves 163 and the upper drawers 162 except the bottom drawer 162 from the front side. Therefore, even if storage items are stored on the shelves 163 and in the drawers 162, it is prevented that the storage items contact the cover 201 of the LEDs 203 and block the light from the LEDs 203. As a result, the inside of the storage compartment can be illuminated.

Meanwhile, when the board 202 on which the LEDs 203 are embedded is provided in each of the tapered surfaces 153*a* and 301*a*, there is a possibility that a bending part 170 at which the side surface wall part is bent to be the tapered surface blocks the light axis of the LEDs. Therefore, as shown in FIG. 22, the cover 201 is arranged to cover the bending part 170 and a portion of the tapered surface bending from the bending part 170. It is thereby prevented that the bending part 170 blocks the light axis of the LEDs 203. As a result, the light axis of the LEDs 203 can emit light through the bending part 170 to illuminate the inside of the storage compartment, which provides flexibility in an angle of arranging the board 202.

Furthermore, if a light-reflecting plate is provided on the surface of the base 703 or the base 703 is made of a light-reflecting material, a part of to light emitted from the LEDs 203 is reflected on the light-reflecting plate or the base 703 made of a light-reflecting material so as to more brightly illuminate the inside of the storage compartment.

It should be noted that the examples of arrangements of the lightning units 302 and 304 in the tapered surfaces are shown in FIGS. 15, 16, 17, 20, and 22. However, as shown in FIGS. 11, 12, and 13, it is also possible in the arrangements of all lightning units that each of the lightning units 302 and 304 are arranged in the side surface wall part 301 behind the tapered surface 153*a* or 301*a* and in front of the attachments 161 by which the shelves 163 are attached, and arranged to have a top level higher than a top level of the attachments 161 and have a bottom level lower than a bottom level of the attachments 161. The attachments 161 are arranged in a vertical line in a plurality of stages.

With the above structure, the lightning units are not arranged in the tapered surfaces having a thickness that is particularly thin. As a result, the heat insulation properties of the tapered surfaces can be increased.

Furthermore, with the above structure, an angle of obliquely arranging the lightning units not in the tapered surface can be decreased more than an angle of obliquely arranging the lightning units in the tapered surface. Thereby, in addition to the increase of the heat insulation properties, it is possible to illuminate the storage items more brightly because a distance between the shelves and the lightning units is shortened.

INDUSTRIAL APPLICABILITY

The present invention is applicable to a refrigerator, and more particularly applicable to a refrigerator having a freezer compartment and a refrigerator compartment arranged side by side.

The invention claimed is:

1. A refrigerator comprising:

a heat-insulating main body having openings in a front side;

a divider creating a first storage compartment and a second storage compartment, by dividing inside of said heat-insulating main body into said first storage compartment and said second storage compartment arranged side by side;

a lighting unit, located close to at least one of said openings of said first and second storage compartments, which has a light-emitting diode as a light source; and attachments, provided vertically at a plurality of positions on an internal side wall of said heat-insulating main body, each of which supports a shelf to be attached, wherein said lighting unit is provided at the internal side wall of said heat-insulating main body, and arranged in front of said attachments to be overlapped with said attachments in a height direction.

2. The refrigerator according to claim 1,
wherein said lightning unit has boards on each of which a plurality of light-emitting diodes including said light-emitting diode are provided, and
said boards are arranged in a vertical line.

3. The refrigerator according to claim 1,
wherein said lightning unit is provided at least in said first storage compartment serving as a refrigerator compartment.

4. The refrigerator according to claim 1,
wherein, when said lightning unit is provided in both said first storage compartment and said second storage compartment, said lighting unit provided in said first storage compartment has a vertical length equal to a vertical length of said lighting unit provided in said second storage compartment, and is arranged at a level equal to a level of said lighting unit provided in said second storage compartment.

5. The refrigerator according to claim 1,
wherein said lighting unit is arranged to occupy more than a half of a width of a ceiling of said first storage compartment.

6. The refrigerator according to claim 1, further comprising attachments, provided vertically at a plurality of positions on said divider, each of which supports a shelf to be attached,
wherein said lighting unit is provided at a side surface of said divider, and arranged in front of said attachments to be overlapped with said attachments in a height direction.

7. The refrigerator according to claim 1, further comprising:
a first door opening and closing at said first storage compartment;
a second door opening and closing at said second storage compartment;
a through hole, provided in said first door, through which an item passes;
a third door opening and closing at said through hole;
a detection unit configured to detect an open state and a closed state of said third door; and
a control unit configured to cause said lighting unit provided in said first storage compartment to turn on, when said detection unit detects the open state.

8. The refrigerator according to claim 7,
wherein an upper end of said lighting unit is higher than an upper end of said thorough-hole, and
a lower end of said lighting unit is lower than a lower end of said thorough-hole.

9. The refrigerator according to claim 1,
wherein said first storage compartment includes:
said lighting unit which is arranged at one of the internal side wall of said heat-insulating main body and said divider; and
a rear-side lighting unit which is arranged at an internal rear surface of said heat-insulating main body and has a light-emitting diode as a light source, and
said lighting unit is not overlapped with said rear-side lighting unit in a height direction.

10. The refrigerator according to claim 1,
wherein a color of light emitted by said lighting unit provided in said first storage compartment is different from a color of light emitted by said lighting unit provided in said second storage compartment.

11. The refrigerator according to claim 1,
wherein intensity of light emitted by said lighting unit provided in said first storage compartment is different from intensity of light emitted by said lighting unit provided in said second storage compartment.

12. The refrigerator according to claim 1,
wherein said light-emitting diode in said lighting unit has a light axis oblique towards an internal rear side of said heat-insulating main body.

13. The refrigerator according to claim 1, further comprising attachments, provided vertically at a plurality of positions on an internal side wall of said heat-insulating main body, each of which supports a shelf to be attached,
wherein said light-emitting diode in said lighting unit is arranged at a level corresponding to a level of a position between said attachments positioned side by side.

14. The refrigerator according to claim 1, further comprising a drawer in said heat-insulating main body,
wherein said lighting unit is arranged in front of said drawer provided in said heat-insulating main body, and has a lower end lower than an upper end of said drawer or has an upper end higher than a lower end of said drawer.

15. The refrigerator according to claim 1, further comprising drawers below said shelf in said heat-insulating main body,
wherein said lightning unit is arranged in front of said shelf and lower than an upper end of a lowest one of said drawers.

16. The refrigerator according to claim 14,
wherein a front side of said drawer is made of a plate through which light passes.

17. The refrigerator according to claim 1,
wherein, when said lightning unit is provided in both said internal side wall and said divider, an angle of arranging a cover of said lightning unit provided in said internal side wall obliquely towards said internal side wall is greater than an angle of arranging a cover of said lightning unit provided in said divider obliquely towards said divider.

18. The refrigerator according to claim 1, further comprising an inner body having a tapered surface created by bending said internal side wall at a part close to said at least one of said openings,
wherein said lightning unit is provided in said tapered surface, and
a cover of said lightning unit covers the part and at least a portion of said tapered surface bending from the part.

19. The refrigerator according to claim 1,
wherein said lightning unit has covers each of which covers a corresponding one of boards on each of which a plurality of light-emitting diodes including said light-emitting diode are provided, and
said covers are arranged in a vertical line with ends overlapped with each other.

20. The refrigerator according to claim 1,
wherein said lightning unit is embedded in an opening that is created by forming a board in an inner body of said refrigerator, the board being provided with a plurality of light-emitting diodes including said light-emitting diode thereon.

21. The refrigerator according to claim 1, further comprising a tapered surface created by bending said internal side wall at a part close to at least one of said openings in said first storage compartment and said second storage compartment,
wherein said lightning unit is arranged in said internal side wall behind said tapered surface and in front of attachments by each of which said shelf is attached, and arranged to have a top level higher than a top level of said attachments and have a bottom level lower than a bottom level of said attachments, said attachments being arranged in a vertical line in a plurality of stages.

* * * * *